US009390722B2

(12) United States Patent
Jeong et al.

(10) Patent No.: US 9,390,722 B2
(45) Date of Patent: Jul. 12, 2016

(54) METHOD AND DEVICE FOR QUANTIZING VOICE SIGNALS IN A BAND-SELECTIVE MANNER

(75) Inventors: Gyuhyeok Jeong, Seoul (KR); Younghan Lee, Seoul (KR); Kibong Hong, Seoul (KR); Hyejeong Jeon, Seoul (KR); Insung Lee, Seoul (KR); Ingyu Kang, Seoul (KR); Lagyoung Kim, Seoul (KR)

(73) Assignees: LG Electronics Inc., Seoul (KR); Chungbuk National University Industry Academic, Chungcheongbuk-do (KR)

( * ) Notice: Subject to any disclaimer, the term of this patent is extended or adjusted under 35 U.S.C. 154(b) by 16 days.

(21) Appl. No.: 14/353,789

(22) PCT Filed: May 4, 2012

(86) PCT No.: PCT/KR2012/003457

§ 371 (c)(1),
(2), (4) Date: Apr. 24, 2014

(87) PCT Pub. No.: WO2013/062201

PCT Pub. Date: May 2, 2013

(65) Prior Publication Data

US 2014/0303967 A1 Oct. 9, 2014

Related U.S. Application Data

(60) Provisional application No. 61/550,456, filed on Oct. 24, 2011.

(51) Int. Cl.

| | |
|---|---|
| ***G10L 19/032*** | (2013.01) |
| ***G10L 19/26*** | (2013.01) |
| *G10L 19/02* | (2013.01) |

(52) U.S. Cl.
CPC ..... *G10L 19/265* (2013.01); *G10L 19/032* (2013.01); *G10L 19/0204* (2013.01)

(58) Field of Classification Search
CPC .. G10L 19/0204; G10L 19/032; G10L 19/265
See application file for complete search history.

(56) References Cited

U.S. PATENT DOCUMENTS 5,842,160 A 11/1998 Zinser
6,850,883 B1 * 2/2005 Kapanen ..... G10L 19/005 704/212

(Continued)

FOREIGN PATENT DOCUMENTS

EP 2101318 * 9/2009
EP 2101318 B1 6/2014

(Continued)

OTHER PUBLICATIONS

European Search Report dated Apr. 10, 2015 from corresponding European Patent Application No. 12844438.7, 9 pages.

(Continued)

*Primary Examiner* — King Poon
*Assistant Examiner* — Ibrahim Siddo
(74) *Attorney, Agent, or Firm* — Fish & Richardson P.C.

(57) ABSTRACT

The present invention relates to a method and device for quantizing voice signals in a band-selective manner. A voice decoding method may include inversely quantizing voice parameter information produced from a selectively quantized voice band and performing inverse transform on the basis of the inversely quantized voice parameter information. Thus, according to the present invention, coding/decoding efficiency in voice coding/decoding may be increased by selectively coding/decoding important information.

9 Claims, 23 Drawing Sheets

(56) References Cited

U.S. PATENT DOCUMENTS

| | | | | |
|---|---|---|---|---|
| 7,283,967 | B2 | 10/2007 | Nishio | |
| 7,328,160 | B2 | 2/2008 | Nishio | |
| 7,392,176 | B2 | 6/2008 | Nishio | |
| 2003/0088328 | A1 | 5/2003 | Nishio | |
| 2003/0088400 | A1 | 5/2003 | Nishio | |
| 2003/0088423 | A1 | 5/2003 | Nishio | |
| 2012/0117442 | A1* | 5/2012 | Lee | 714/755 |

FOREIGN PATENT DOCUMENTS

| | | | |
|---|---|---|---|
| JP | 09-046233 | A | 2/1997 |
| JP | 2003-015698 | A | 1/2003 |
| JP | 2003065822 | A | 3/2003 |
| JP | 2003-140692 | A | 5/2003 |
| JP | 2003256411 | A | 9/2003 |
| JP | 2003314429 | A | 11/2003 |
| JP | 2008519991 | T | 11/2008 |
| JP | 2011504733 | T | 7/2012 |
| WO | WO 03/038389 | A1 | 5/2003 |
| WO | WO 03/038812 | A1 | 5/2003 |
| WO | WO 03/038813 | A1 | 5/2003 |
| WO | WO2006051451 | A1 | 5/2006 |
| WO | WO2008072670 | A1 | 6/2008 |
| WO | WO2009068279 | A1 | 6/2009 |

OTHER PUBLICATIONS

Salavedra, J.M., et al., "APVQ encoder applied to wideband speech coding", Spoken Language, 1996 Proceedings, Fourth International Conference in Philadelphia, PA, USA, vol. 2, Oct. 3, 1996, pp. 941-944, XP010237775.

International Search Report dated Nov. 28, 2012 for Application No. PCT/KR2012/003457, with English Translation, 4 pages.

Office Action dated Jul. 21, 2015 for corresponding Japanese Application No. 2014-538688, 4 pages.

Office Action dated Oct. 29, 2015 for corresponding Chinese Application No. 201280062478.6, 6 pages.

* cited by examiner (a)

(b)

METHOD AND DEVICE FOR QUANTIZING VOICE SIGNALS IN A BAND-SELECTIVE MANNER

CROSS REFERENCE TO RELATED APPLICATIONS

This application is a U.S. National Phase Application under 35 U.S.C. §371 of International Application PCT/KR2012/003457, filed on May 4, 2012, which claims the benefit of U.S. Provisional Application No. 61/550,456, filed on Oct, 24, 2011, the entire content of the prior applications is hereby incorporated by reference.

TECHNICAL FIELD

The present invention relates to a method of quantizing a voice signal in a band-selective manner and a device using the method, and more particularly, to voice encoding/decoding method and device.

BACKGROUND ART

Voice communications are mainly used in current mobile communications. A voice signal generated by a person can be expressed as an electrical analog signal. A wired telephone transmits the analog signal, and reproduces the transmitted electrical analog signal into a voice signal.

With recent development of information technology, a method capable of more flexibly transmitting more information than an existing analog system for transmitting an electrical analog signal has been studied. As a result, a voice signal has been changed from analog to digital. A digital voice signal requires a broader bandwidth for transmission than an analog voice signal, but has a lot of merits in a lot of points such as signal transmission, flexibility, security, and cooperation with other systems. Voice compression techniques have been developed in order to complementing the disadvantage of a broad bandwidth in a digital voice signal. The change of a voice signal from analog to digital has been accelerated by the voice compression techniques, which occupy an important part of information communications.

Audio codecs can be classified into a middle-rate or low-rate codec of 16 kbps or less and a high-rate codec depending on a method of modeling a signal in compressing a voice signal. The high-rate codec uses a waveform coding system to compress a voice signal in consideration of how accurately a receiving party reconstructs an original signal. A codec enabling such a coding system is referred to as a waveform coder. On the other hand, the middle-rate or low-rate codec uses a source coding system to compress a voice signal, because the number of bits expressing an original signal decreases. The receiving party codes the voice signal using a voice signal generation model in consideration of how similar to an original signal. A coder employing such a coding system is referred to as a vocoder.

SUMMARY OF INVENTION

Technical Problem

An object of the present invention is to provide a method of selectively performing quantization and dequantization by frequency bands of a voice signal so as to enhance voice encoding efficiency.

Another object of the present invention is to provide a method of selectively performing quantization and dequantization by frequency bands of a voice signal so as to enhance voice decoding efficiency.

Technical Solution

According to an aspect of the present invention, there is provided a voice decoding method including the steps of: dequantizing voice parameter information extracted from a selectively-quantized voice band; and performing an inverse transform on the basis of the dequantized voice parameter information. The selectively-quantized voice band may include at least one predetermined fixed low-frequency voice band to be quantized and at least one selected high-frequency voice band to be quantized. The at least one selected high-frequency voice band may be a high-frequency band having a large energy portion which is selected on the basis of energy distribution information of a voice band. The step of performing the inverse transform on the basis of the dequantized voice parameter information may include performing the inverse transform by applying different codebooks to the voice band to be quantized which are selected on the basis of the dequantized voice parameter information. The voice band to be quantized may include at least one predetermined fixed low-frequency voice band to be quantized and at least one selected high-frequency voice band to be quantized. The step of performing the inverse transform by applying different codebooks to the voice band to be quantized may include reconstructing a voice signal on the basis of a first codebook and a voice parameter of the dequantized low-frequency voice band to be quantized and reconstructing a voice signal on the basis of a second codebook and a voice parameter of the dequantized high-frequency voice band to be quantized. The step of performing the inverse transform on the basis of the dequantized voice parameter information may include reconstructing a voice signal by applying a dequantized comfort noise level to a voice band not to be quantized. The selectively-quantized voice band may include a predetermined at least one fixed low-frequency voice band to be quantized and at least one selected high-frequency voice band to be quantized. The step of dequantizing the voice parameter information extracted from the selectively-quantized voice band may include dequantizing the voice parameter information extracted from the high-frequency voice band to be quantized which is selected by a combination most similar to an original signal and the at least one predetermined fixed low-frequency voice band to be quantized using analysis-by-synthesis (AbS). The step of performing the inverse transform on the basis of the dequantized voice parameter information may include performing the inverse transform on the high-frequency voice band to be quantized using an inverse direct Fourier transform (IDFT) and performing the inverse transform on the low-frequency voice band to be quantized using an inverse fast Fourier transform (IFF).

According to another aspect of the present invention, there is provided a voice decoder including: a dequantization unit that dequantizes voice parameter information extracted from a selectively-quantized voice band; and an inverse transform unit that performs an inverse transform on the basis of the voice parameter information dequantized by the dequantization unit. The selectively-quantized voice band may include a at least one predetermined fixed low-frequency voice band to be quantized and at least one selected high-frequency voice band to be quantized. The inverse transform unit may reconstruct a voice signal by determining a voice band to be quantized on the basis of the dequantized voice parameter information and applying different codebooks to the voice band to be quantized. The dequantization unit may dequantize the voice parameter information extracted from the high-frequency voice band to be quantized which is selected by a combination most similar to an original signal and the at least one predetermined fixed low-frequency voice band to be quantized using analysis-by-synthesis (AbS). The inverse transform unit may perform the inverse transform on the high-frequency voice band to be quantized using an inverse direct Fourier transform (IDFT) and may perform the inverse transform on the low-frequency voice band to be quantized using an inverse fast Fourier transform (IFF).

Advantageous Effects

By employing the above-mentioned method and device for quantizing a voice signal in a band-selective manner according to the aspects of the present invention, it is possible to reduce an amount of unnecessary information to enhance voice coding efficiency by selectively quantizing only some bands including important information when quantizing voice parameter information. It is also possible to reconstruct a signal closest to a time-axis voice signal by selecting some bands by the AbS.

DESCRIPTION OF DRAWINGS

FIG. 1 is a conceptual diagram illustrating a voice encoder according to an embodiment of the present invention.

FIG. 2 is a conceptual diagram illustrating a TCX mode executing unit that performs a TCX mode according to an embodiment of the present invention.

FIG. 3 is a conceptual diagram illustrating a CELP mode executing unit that performs a CELP mode according to an embodiment of the present invention.

FIG. 4 is a conceptual diagram illustrating a voice decoder according to an embodiment of the invention.

FIG. 15 is a diagram illustrating an encoding method in a TCX mode using an analysis-by-synthesis (AbS) method according to an embodiment of the present invention.

FIG. 16 is a conceptual diagram illustrating a method of applying a band-selection IDFT to an AbS structure according to an embodiment of the present invention.

FIG. 17 is a conceptual diagram illustrating a band-selection IDFT process which is performed in the front stage of an AbS structure according to an embodiment of the present invention.

FIG. 18 is a conceptual diagram illustrating an encoding method in a TCX mode using an AbS structure according to an embodiment of the present invention.

FIG. 19 is a flowchart illustrating a dequantization process of a TCX mode block using an AbS structure according to an embodiment of the present invention.

FIG. 20 is a conceptual diagram illustrating a part (a dequantization unit of the TCX mode block using an AbS structure) of a voice decoder according to an embodiment of the present invention.

MODE FOR INVENTION

Hereinafter, embodiments of the invention will be specifically described with reference to the accompanying drawings. When it is determined that detailed description of known configurations or functions involved in the invention makes the gist of the invention obscure, the detailed description thereof will not be made.

If it is mentioned that an element is "connected to" or "coupled to" another element, it should be understood that still another element may be interposed therebetween, as well as that the element may be connected or coupled directly to another element. When it is mentioned in the present invention that a specific element is "included", it does not mean excluding an element other than the specific element, but it means that an additional element may be included in an embodiment of the present invention or the scope of the technical spirit of the present invention.

Terms such as "first" and "second" can be used to describe various elements, but the elements are not limited to the terms. The terms are used only for distinguishing one element from another element. For example, an element named a first element within the technical spirit of the invention may be named a second element and an element named a second element may be similarly named a first element.

The constituent units described in the embodiments of the invention are independently shown to represent different distinctive functions. Each constituent unit is not constructed by an independent hardware or software unit. That is, the constituent units are independently arranged for the purpose of convenience for explanation and at least two constituent units may be combined into a single constituent unit or a single constituent unit may be divided into plural constituent units to perform functions. Embodiments in which the elements are combined and/or split belong to the scope of the invention without departing from the concept of the invention.

Some elements may not be essential elements for performing essential functions of the invention but may be selective elements for merely improving performance. The invention may be embodied by only the elements essential to embody the invention, other than the elements used to merely improve performance, and a structure including only the essential elements other than the selective elements used to merely improve performance belongs to the scope of the invention.

Figure 1:
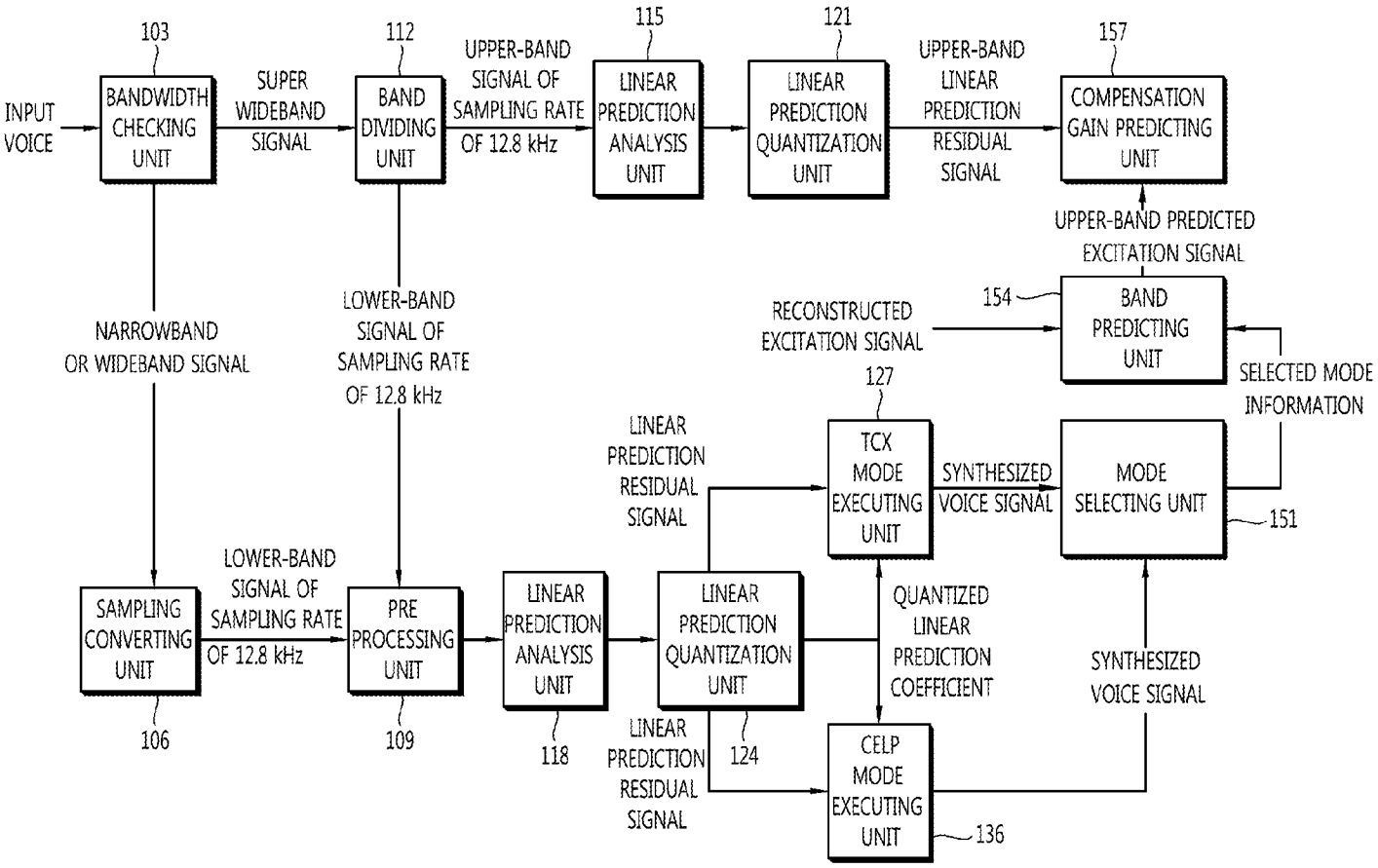
FIGS. 1 to 4 are conceptual diagrams illustrating a voice encoder and a voice decoder according to an embodiment of the present invention.

FIG. 1 is a conceptual diagram illustrating a voice encoder according to an embodiment of the invention.

Referring to FIG. 1, a voice encoder includes a bandwidth checking unit 103, a sampling and conversion unit 106, a pre-processing unit 109, a band dividing unit 112, linear-prediction and analysis units 115 and 118, linear-prediction and quantization units 121 and 124, a TCX mode execution unit 127, a CELP mode execution unit 136, a mode selecting unit 151, a band predicting unit 154, and a compensation gain predicting unit 157.

FIG. 1 illustrates an example of a voice encoder. The voice encoder according to the embodiment of the present invention may have another configuration without departing from the concept of the present invention. The constituent units illustrated in FIG. 1 are independently shown to represent different distinctive functions. Each constituent unit is not constructed by an independent hardware or software unit. That is, the constituent units are independently arranged for the purpose of convenience for explanation and at least two constituent units may be combined into a single constituent unit or a single constituent unit may be divided into plural constituent units to perform functions. Embodiments in which the elements are combined and/or split belong to the scope of the invention without departing from the concept of the invention. Some elements may not be essential elements for performing essential functions of the invention but may be selective elements for merely improving performance. For example, a voice encoder in which unnecessary constituent units are removed from FIG. 1 depending on the bandwidth of a voice signal may be embodied. This voice encoder also belongs to the scope of the present invention.

The present invention may be embodied by only the elements essential to embody the invention, other than the elements used to merely improve performance, and a structure including only the essential elements other than the selective elements used to merely improve performance belongs to the scope of the present invention.

The bandwidth checking unit 103 may determine bandwidth information of an input voice signal. Depending on bandwidths thereof, voice signals can be classified into a narrowband signal which has a bandwidth of about 4 kHz and which is often used in a public switched telephone network (PSTN), a wideband signal which has a bandwidth of about 7 kHz, which is more natural than the narrowband voice signal, and which is often used in high-quality speech or AM radio, a super-wideband signal which has a bandwidth of about 14 kHz and which is often used in the fields in which sound quality is emphasized such as music and digital broadcast, and a full-band signal which has a bandwidth of about 20 kHz. The bandwidth checking unit 103 may transform an input voice signal to a frequency domain and may determine a bandwidth of a current voice signal.

The encoding operation of the voice encoder may vary depending on the bandwidth of a voice signal. For example, when an input voice signal is a super-wideband signal, the input voice signal is input to only the band dividing unit 112 and the sampling converting unit 106 is not activated. When an input voice signal is a narrowband signal or a wideband signal, the input voice signal is input to only the sampling converting unit 106 and the band dividing unit 112 and the constituent units 115, 121, 157, and 154 subsequent thereto are not activated. In some embodiments, the bandwidth checking unit 103 may not include in the voice encoder when the bandwidth of an input voice signal is fixed.

The sampling converting unit 106 may change the input narrowband signal or the input wideband signal into a constant sampling rate. For example, when the sampling rate of the input narrowband signal is 8 kHz, the input voice signal may be up-sampled to 12.8 kHz to generate an upper-band signal. When the sampling rate of the input wideband signal is 16 kHz, the input voice signal may be down-sampled to 12.8 kHz to generate a lower-band signal. The internal sampling frequency may be a frequency other than 12.8 kHz.

The pre-processing unit 109 may perform a pre-processing operation on the voice signal having the changed internal sampling frequency by the sampling converting unit 106. By the pre-processing, it is possible to effectively extract a voice parameter. For example, the pre-processing unit 109 may use the high-pass filtering or the pre-emphasis filtering to extract a frequency component of an important band. For example, the pre-processing unit 109 may focus an important band required for extracting a parameter by setting a cutoff frequency to be different depending on the bandwidth of a voice signal. The pre-processing unit 109 may perform a high-pass filtering to filter very low frequencies which are frequency bands including relatively less important information. For example, the pre-processing unit 109 boosts a high frequency band of an input voice signal and scales energy of a low frequency band and a high frequency band. By the boosting and the scaling, a resolution for linear prediction and analysis may be raised.

The band dividing unit 112 may convert the sampling rate of an input super-wideband signal and may divide the frequency band thereof into an upper band and a lower band. For example, a voice signal of 32 kHz may be converted into a sampling frequency of 25.6 kHz. The voice signal converted into a sampling frequency of 25.6 kHz may be divided into an upper band and a lower band by 12.8 kHz. The lower band may be transmitted to the pre-processing unit 109 for filtering.

The linear-prediction analysis unit 118 may calculate linear prediction coefficients (LPC). The linear-prediction analysis unit 118 may model a formant representing the entire shape of a frequency spectrum of a voice signal. The linear-prediction analysis unit 118 may calculate the LPC values so that the mean square error (MSE) of error values which are differences between an original voice signal and a predicted voice signal generated using the linear prediction coefficients calculated by the linear-prediction analysis unit 118. Various LPC coefficient calculating methods such as an autocorrelation method and a covariance method may be used to calculate the LPCs.

The linear-prediction quantization unit 124 may convert the LPCs extracted from the lower-band voice signal into transform coefficients of the frequency domain such as LSP or LSF and may quantize the transform coefficients. The LPCs have a wide dynamic range. Accordingly, when the LPCs are transmitted without any change, the compression rate is lowered. As a result, it is possible to generate LPC information with a small amount of information using transform coefficients transformed to the frequency domain. The linear-prediction quantization unit 124 may quantize and encode the LPC coefficient. The linear-prediction quantization unit 124 may transmit linear prediction residual signal. The linear prediction residual signal includes pitch information which are a signal from which formant components are excluded using the LPCs dequantized and transformed to the time domain, and a random signal. The linear prediction residual signal may be transmitted to the subsequent stage of the linear-prediction quantization unit 124. In the upper band, the linear prediction residual signal may be transmitted to the compensation gain predicting unit 157. In the lower band, the linear prediction residual signal in the lower band may be transmitted to the TCX mode executing unit 127 and the CELP mode executing unit 136.

The following embodiment of the present invention will describe a method of encoding the linear prediction residual signal of a narrowband signal or a wideband signal in the transform coded excitation (TCX) mode or the code excited linear prediction (CELP) mode.

Figure 2:
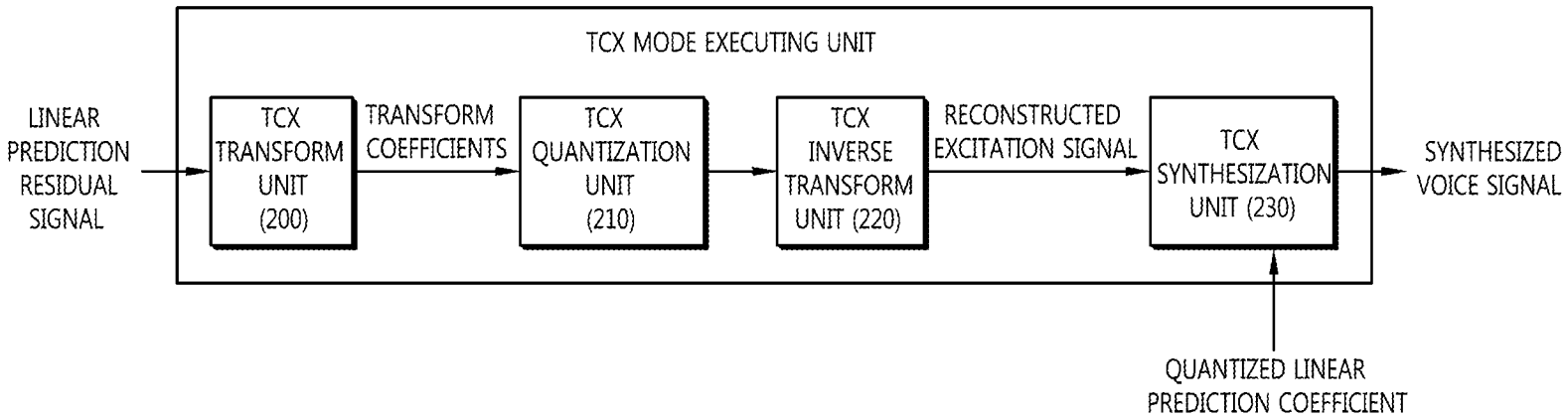

FIG. 2 is a conceptual diagram illustrating the TCX mode executing unit that performs the TCX mode according to an embodiment of the present invention.

The TCX mode executing unit may include a TCX transform unit 200, a TCX quantization unit 210, a TCX inverse transform unit 220, and a TCX synthesization unit 230.

The TCX transform unit 200 may transform an input residual signal to the frequency domain on the basis of a transform function such as a discrete Fourier transform (DFT) or a modified discrete cosine transform (MDCT) and may transform coefficient information to the TCX quantization unit 210.

The TCX quantization unit 210 may quantize the transform coefficients transformed by the TCX transform unit 200 using various quantization methods. According to an embodiment of the present invention, the TCX quantization unit 210 may selectively perform quantization depending on the frequency band and may calculate an optimal frequency combination using an analysis-by-synthesis (AbS) method. The embodiment of the present invention will be described below.

The TCX inverse transform unit 220 may inversely transform the linear prediction residual signal, which has been transformed to the frequency domain by the transform unit, to an excitation signal of the time domain on the basis of the quantized information.

The TCX synthesization unit 230 may calculate a synthesized voice signal using the inversely-transformed linear prediction coefficient values quantized in the TCX mode and the reconstructed excitation signal. The synthesized voice signal may be supplied to the mode selecting unit 151 and the voice signal reconstructed in the TCX mode may be quantized in a CELP mode to be described later and may be compared with the reconstructed voice signal.

Figure 3:
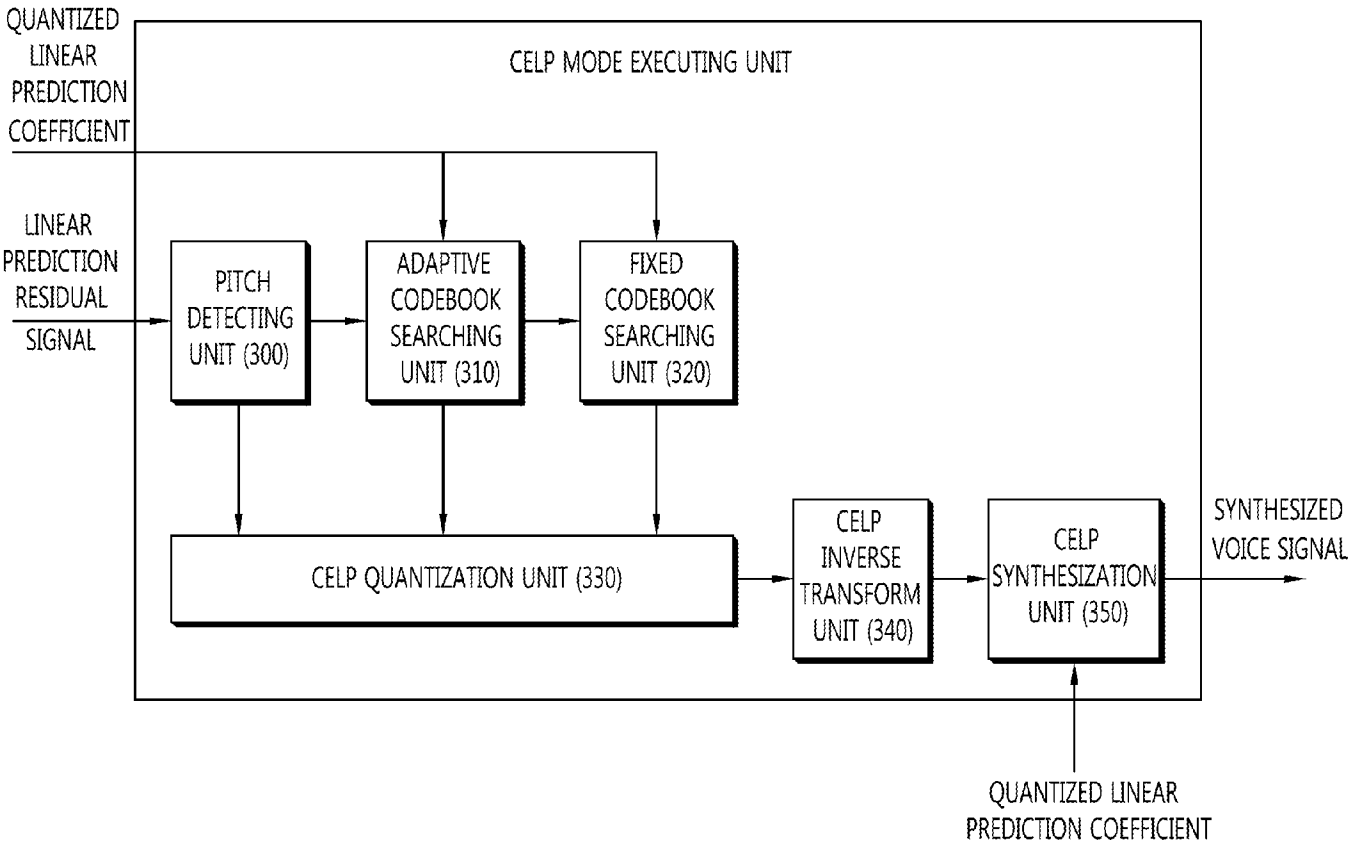

FIG. 3 is a conceptual diagram illustrating a CELP mode executing unit that performs the CELP mode according to an embodiment of the present invention.

The CELP mode executing unit includes a pitch detecting unit 300, an adaptive codebook searching unit 310, a fixed codebook searching unit 320, a CELP quantization unit 330, a CELP inverse transform unit 340, and a CELP synthesization unit 350.

The pitch detecting unit 300 may acquire period information and peak information of pitches on the basis of the linear prediction residual signal using an open-loop method such as an autocorrelation method.

The pitch detecting unit 300 may compare the synthesized voice signal with an actual voice signal and may calculate the pitch period (peak value). The calculated pitch information may be quantized by the CELP quantization unit and may be transmitted to the adaptive codebook searching unit. The adaptive codebook searching unit may calculate pitch period (pitch value) based on a method such as the AbS method.

The adaptive codebook searching unit 310 may calculate a pitch structure from the linear prediction residual signal based on the quantized pitch information, for example, using the AbS method. The quantized pitch information is generated based on the pitch detecting unit 300. The adaptive codebook searching unit 310 may generate a random signal component other than the pitch structure.

The fixed codebook searching unit 320 may encode the random signal component generated by the adaptive codebook searching unit 310 by using codebook index information and codebook gain information. The codebook index information and the codebook gain information determined by the fixed codebook searching unit 320 may be quantized by the CELP quantization unit 330.

The CELP quantization unit 330 may quantize the pitch-relevant information and the codebook-relevant information determined by the pitch detecting unit 300, the adaptive codebook searching unit 310, and the fixed codebook searching unit 320 as described above.

The CELP inverse transform unit 340 may reconstruct an excitation signal using the information quantized by the CELP quantization unit 330.

The CELP synthesization unit 350 may calculate a synthesized voice signal on the basis of the reconstructed voice signal and the quantized linear prediction coefficients by performing the inverse processes of the linear prediction on the reconstructed excitation signal which is the inversely-transformed linear prediction residual signal quantized in the CELP mode. The voice signal reconstructed in the CELP mode may be supplied to the mode selecting unit 151 and may be compared with the voice signal reconstructed in the TCX mode.

The mode selecting unit 151 may compare the TCX-reconstructed voice signal generated from the excitation signal reconstructed in the TCX mode with the CELP-reconstructed voice signal generated from the excitation signal reconstructed in the CELP mode, may select the signal more similar to the original voice signal, and may encode mode information on the encoding mode. The selection information may be transmitted to the band predicting unit 154.

The band predicting unit 154 may generate an upper-band predicted excitation signal using the selection information transmitted from the mode selecting unit 151 and the reconstructed excitation signal.

The compensation gain predicting unit 157 may compare the upper-band prediction residual signal with the upper-band predicted excitation signal transmitted from the band predicting unit 154 and may compensate for the gain in spectrum.

Figure 4:
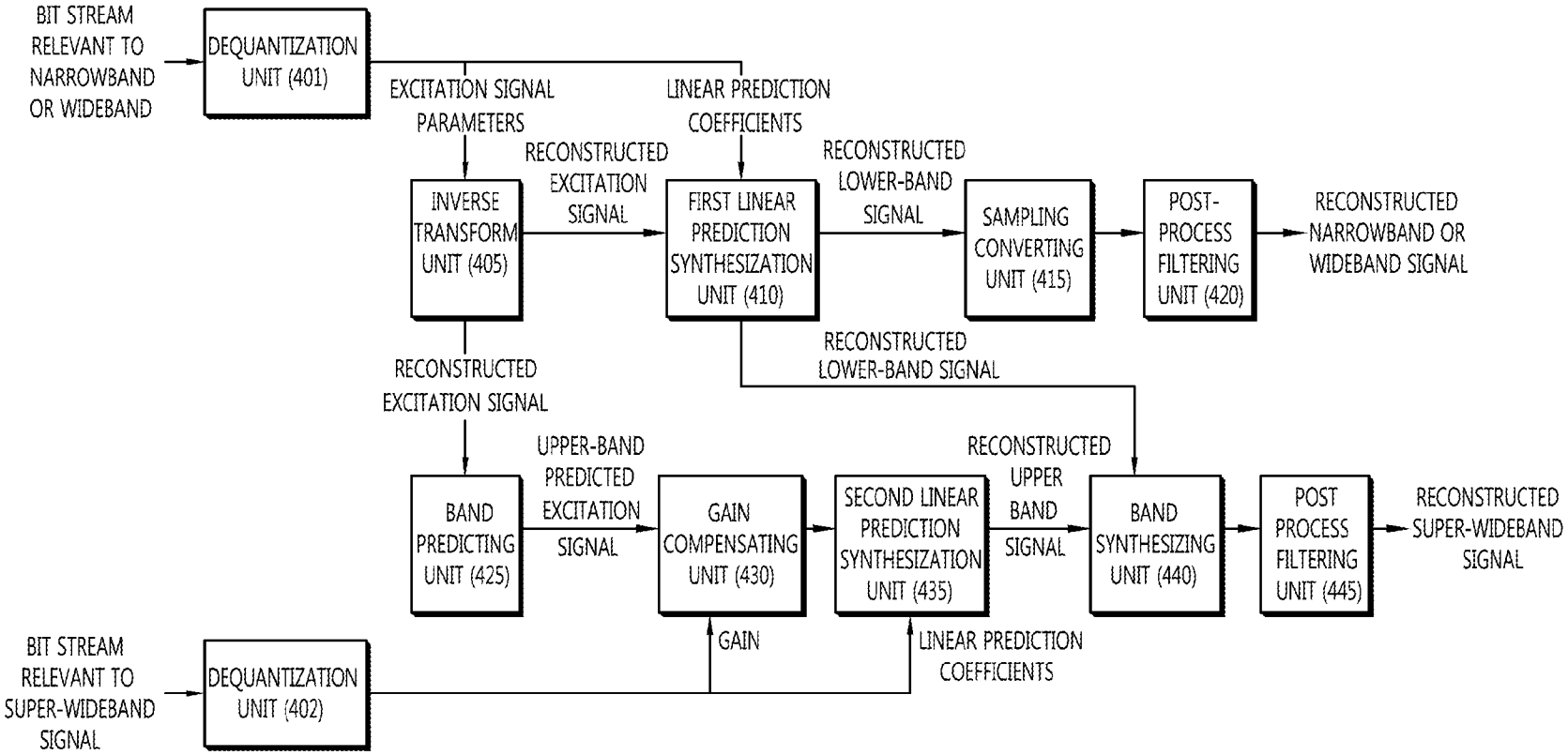

FIG. 4 is a conceptual diagram illustrating a voice decoder according to an embodiment of the invention.

Referring to FIG. 4, the voice decoder includes dequantization units 401 and 402, an inverse transform unit 405, a first linear prediction and synthesis unit 410, a sampling converting unit 415, post-process filtering units 420 and 445, a band predicting unit 440, a gain compensating unit 430, a second linear prediction and synthesis unit 435, and a band synthesizing unit 440.

The dequantization units 401 and 402 may dequantize parameter information quantized by the voice encoder and may supply the dequantized parameter information to the constituent units of the voice decoder.

The inverse transform unit 405 may inversely transform the voice information encoded in the TCX mode or the CELP mode and may reconstruct an excitation signal. According to an embodiment of the present invention, the inverse transform unit may perform only the inverse transform on some bands selected by the voice encoder. The embodiment of the present invention will be described below in detail. The reconstructed excitation signal may be transmitted from the first linear prediction and synthesization unit 410 and the band predicting unit 425.

The first linear prediction and synthesization unit 410 may reconstruct a lower-band voice signal using the excitation signal transmitted from the inverse transform unit 405 and the linear prediction coefficient information transmitted from the voice encoder. The reconstructed lower-band voice signal may be transmitted to the sampling converting unit 415 and the band synthesizing unit 440.

The band predicting unit 425 may generate an upper-band predicted excitation signal on the basis of the reconstructed excitation signal values transmitted from the inverse transform unit 405.

The gain compensating unit 430 may compensate for the gain in spectrum of a super-wideband voice signal on the basis of the upper-band predicted excitation signal transmitted from the band predicting unit 425 and the compensated gain value transmitted from the voice encoder.

The second linear prediction and synthesization unit 435 may reconstruct an upper-band voice signal on the basis of the compensated upper-band predicted excitation signal values transmitted from the gain compensating unit 430 and the linear prediction coefficient values transmitted from the voice encoder.

The band synthesizing unit 440 may synthesize the bands of the reconstructed lower-band voice signal transmitted from the first linear prediction and synthesization unit 410 and the band of the reconstructed upper-band voice signal transmitted from the second linear prediction and synthesization unit 435.

The sampling converting unit 415 may convert the internal sampling frequency value to the original sampling frequency value again.

The post-process filtering units 420 and 445 may include, for example, a de-emphasis filter that can perform inverse filtering of the pre-emphasis filter in the pre-processing unit (109). The post-process filtering units may perform various post-processing operations such as an operation of minimizing a quantization error and an operation of reviving harmonic peaks and suppressing valleys as well as the filtering operation.

As described above, the voice encoder illustrated in FIGS. 1 and 2 is an example of the present invention, may employ another voice encoder structure without departing from the concept of the present invention, and such an embodiment is also included in the scope of the present invention.

Figure 5:
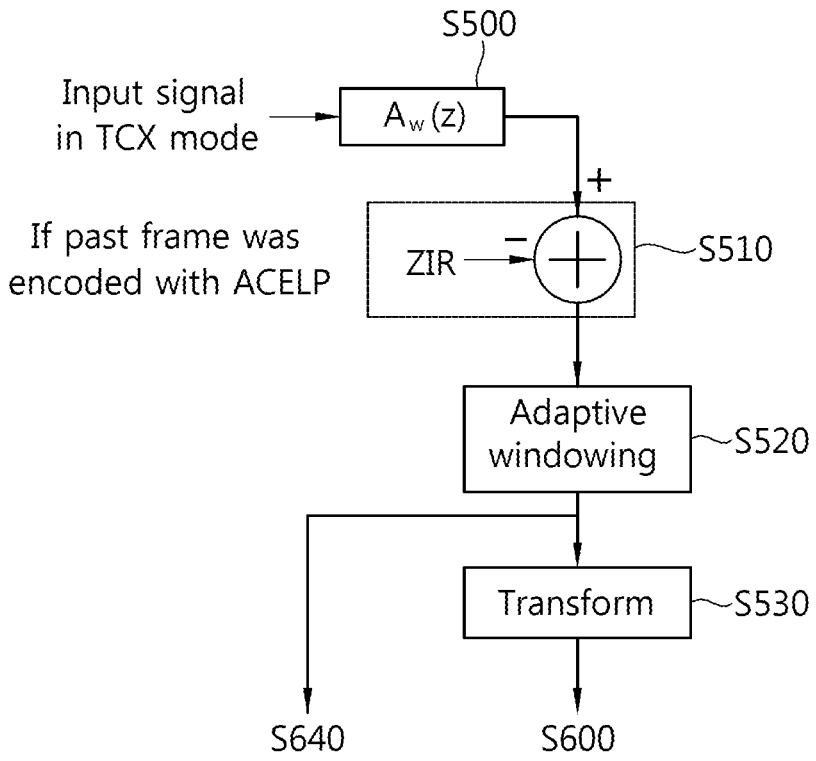
FIGS. 5 to 7 are flowcharts illustrating a method of performing an encoding operation in the TCX mode according to an embodiment of the present invention.
Figure 6:
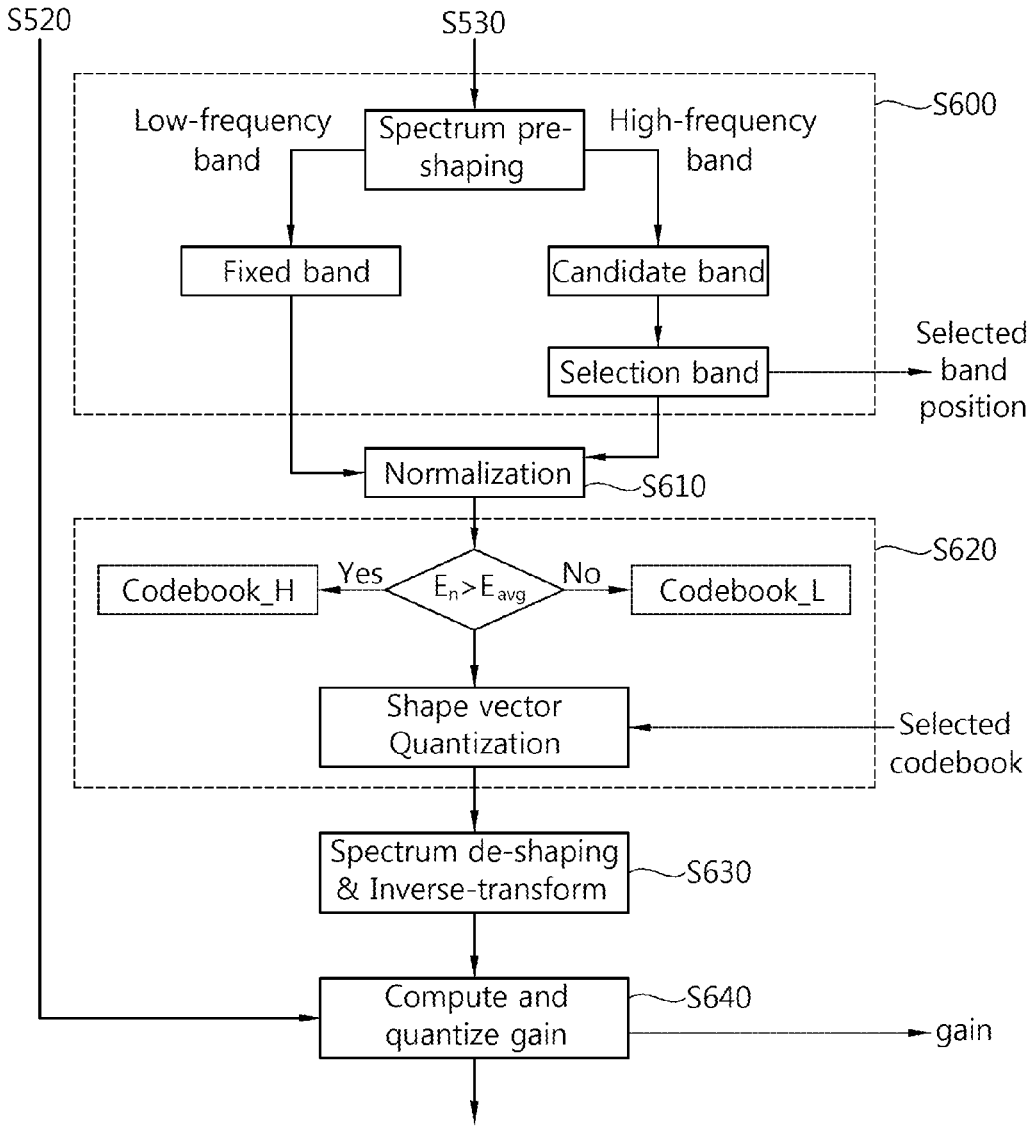
Figure 7:
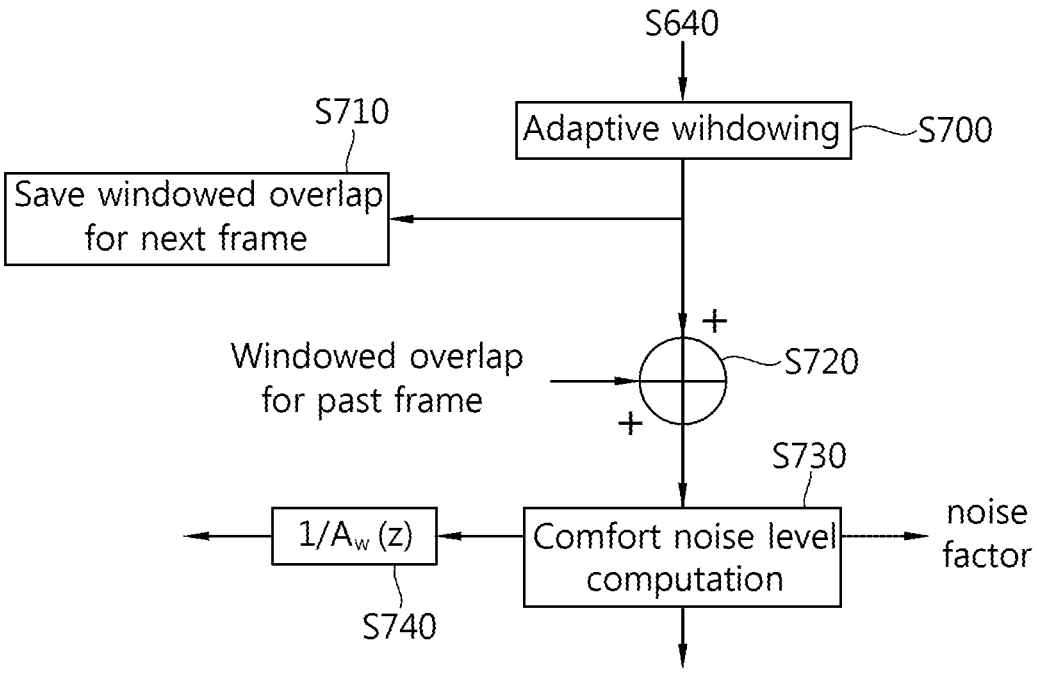

FIGS. 5 to 7 are flowcharts illustrating a method of performing an encoding operation in the TCX mode according to an embodiment of the present invention.

In the TCX encoding method according to the embodiment of the present invention, it is possible to achieve higher encoding efficiency by using a method of selectively performing quantization depending on a degree of importance of a signal.

Referring to FIG. 5, a target signal of an input voice signal is calculated (step S500). The target signal is a linear prediction residual signal of which a short-term correlation between voice samples is removed in the time axis.

Aw(z) represents a filter including quantized linear prediction coefficients (LPCs) subjected to LPC analysis and quantization. The input signal may pass through the Aw(z) filter to output a linear prediction residual signal. The linear prediction residual signal may be a target signal to be encoded in the TCX mode.

When a previous frame is encoded in a mode other than the TCX mode, a zero-input response (ZIR) is removed (step S510).

For example, when the previous frame is a frame encoded in an ACELP mode other than the TCX mode, a zero-input response by the combination of a weighting filter and a synthesis filter may be removed from a weighted signal so as to cancel the influence on an output value due to the previous input signal.

Then, an adaptive windowing operation is performed (step S520).

As described above, the linear prediction residual signal may be encoded using plural methods such as the TCX and the CELP. When continuous frames are encoded using different methods, degradation in voice quality may be caused at the boundary between the frames. Accordingly, when the previous frame is encoded in a mode other than that of the current frame, the continuity between frames may be acquired using the windowing operation.

Subsequently, a transform operation is performed (step S530).

The windowed linear prediction residual signal may be transformed from a time-domain signal to a frequency-domain signal using a transform function such as the DFT or the MDCT.

Referring to FIG. 6, the linear prediction residual signal transformed in step S530 is subjected to spectrum pre-shaping and band division (step S600).

In the method of dividing a voice signal band according to the embodiment of the present invention, the linear prediction residual signal may be divided into a low frequency band and a high frequency band depending on the frequencies and may be encoded. By using the method of dividing a band, it is possible to determine whether to perform quantization depending on the degree of important of the band. The following embodiment of the present invention will describe a method of quantizing some fixed low frequency bands and selectively quantizing bands having a large energy portion out of upper high frequency bands. A band to be quantized may be referred to as a frequency band to be quantized, plural fixed low frequency bands may be referred to as fixed low-frequency bands, and plural high-frequency bands to be selectively quantized may be referred to as selected high-frequency bands.

Arbitrarily, a frequency band is divided into a high-frequency band and a low-frequency band and a frequency band to be quantized is selected out of the divided frequency bands. Accordingly, without departing from the concept of the present invention, another frequency band dividing method may be used to select a frequency band and the number of frequency bands to be quantized may vary. This embodiment also belongs to the scope of the present invention. The following embodiment of the present invention will describe that the DFT is used as the transform method for the purpose of convenience of explanation, but another transform method (for example, MDCT) may be used. This embodiment also belongs to the scope of the present invention.

A target signal in the TCX mode is transformed to coefficients in the frequency domain through the spectrum pre-shaping. For the purpose of convenience of explanation, the embodiment of the present invention will describe a sequence of processing a frame section of 20 ms (256 samples) at an internal sampling rate of 12.8 kHz, but the specific values (the number of frequency coefficients and the feature values of band division) may be changed with a change in frame size.

The coefficients in the frequency domain may be transformed to a frequency-domain signal having 288 samples, and the transformed frequency-domain signal may be divided into 36 bands each having 8 samples. The frequency-domain signal may be subjected to pre-shaping of alternately rearranging and grouping the real parts and the imaginary parts so as to divide the frequency-domain signal into 36 bands each having 8 samples. For example, when 288 samples are subjected to the DFT, the samples are arranged to be symmetric about Fs/2 in the frequency domain and thus the coefficients to be encoded may be 144 frequency-domain samples. A frequency-domain coefficient has a real part and an imaginary part. Accordingly, the real parts and the imaginary parts may be alternately rearranged for quantization so as to group 288 samples by 8 samples to form 36 bands. Expression 1 represents divided frequency-domain signals.

$$X_n(k)=X(n\times 8+k),\ k=0,\ldots,7\ n=0,\ldots,35 \qquad \text{<Expression 1>}$$

Here, four low-frequency bands ($X_n(k)$ n=0, - - - , 3 may be fixed and four important frequency bands out of 32 high-frequency bands may be selected and defined as quantization-selected bands based on an energy distribution. Finally, the quantization-selected bands may be 8 bands ($\tilde{X}_n(k)$ n=0, - - - , 7) including four low-frequency bands and four high-frequency bands. As described above, the number of frequency bands to be quantized is arbitrary and may be changed. Information on the positions of the selected bands may be transmitted to the voice decoder.

Figure 8:
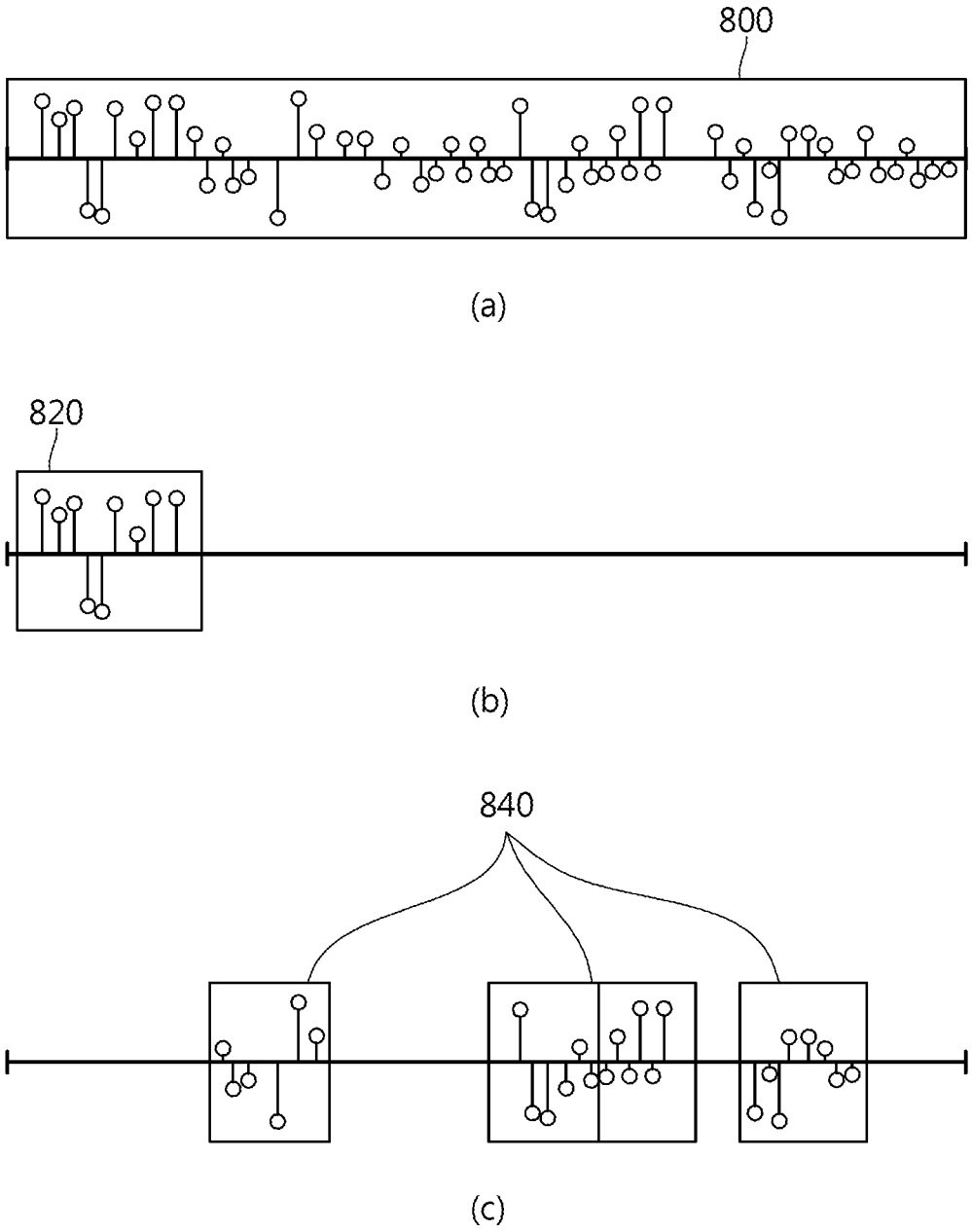
FIG. 8 is a diagram illustrating an example of a quantization target band selecting method according to an embodiment of the present invention.

FIG. 8 is a diagram illustrating an example of a method of selecting a band to be quantized according to an embodiment of the present invention.

Referring to FIG. 8, the horizontal axis in the upper part of FIG. 8 represents the frequency band (800) when an original linear prediction residual signal is transformed to the frequency domain. As described above, the frequency transform coefficients of the linear prediction residual signal may be divided into 32 bands depending on the frequency bands, and 8 frequency bands of four fixed low-frequency bands 820 and four selected high-frequency bands 840 in the frequency bands of the original linear prediction residual signal may be selected frequency bands to be quantized. In selecting 8 selected frequency bands, 32 frequency bands other than the four fixed low-frequency bands are arranged in a descending order of energy and 8 upper frequency bands are selected.

Referring to FIG. 6 again, the selected quantized bands may be normalized (step S610).

The total energy of the frequency bands to be quantized may be calculated by calculating energy (E(n) n=0, . . . , 7) of each selected frequency band using Expression 2.

$$E(n)=\sum_{k=0}^{7}\{\overline{X}_n(k)\}^2 \quad n=0,\ldots,7 \qquad \text{⟨Expression 2⟩}$$

$$E_{total}=\sum_{n=0}^{7}\{E(n)\}$$

The total energy may be divided by the number of selected samples to calculate a gain G to be finally normalized. The selected frequency bands to be quantized may be divided by the gain calculated through Expression 3 to finally acquire normalized signals M(k).

$$G=\sqrt{\frac{1}{64}\cdot E_{total}} \qquad \text{⟨Expression 3⟩}$$

$$M(n\times 8+k)=\frac{1}{G}\cdot\overline{X_n}(k)$$

$$k=0,\cdots,7\ n=0,\ldots,7$$

Figure 9:
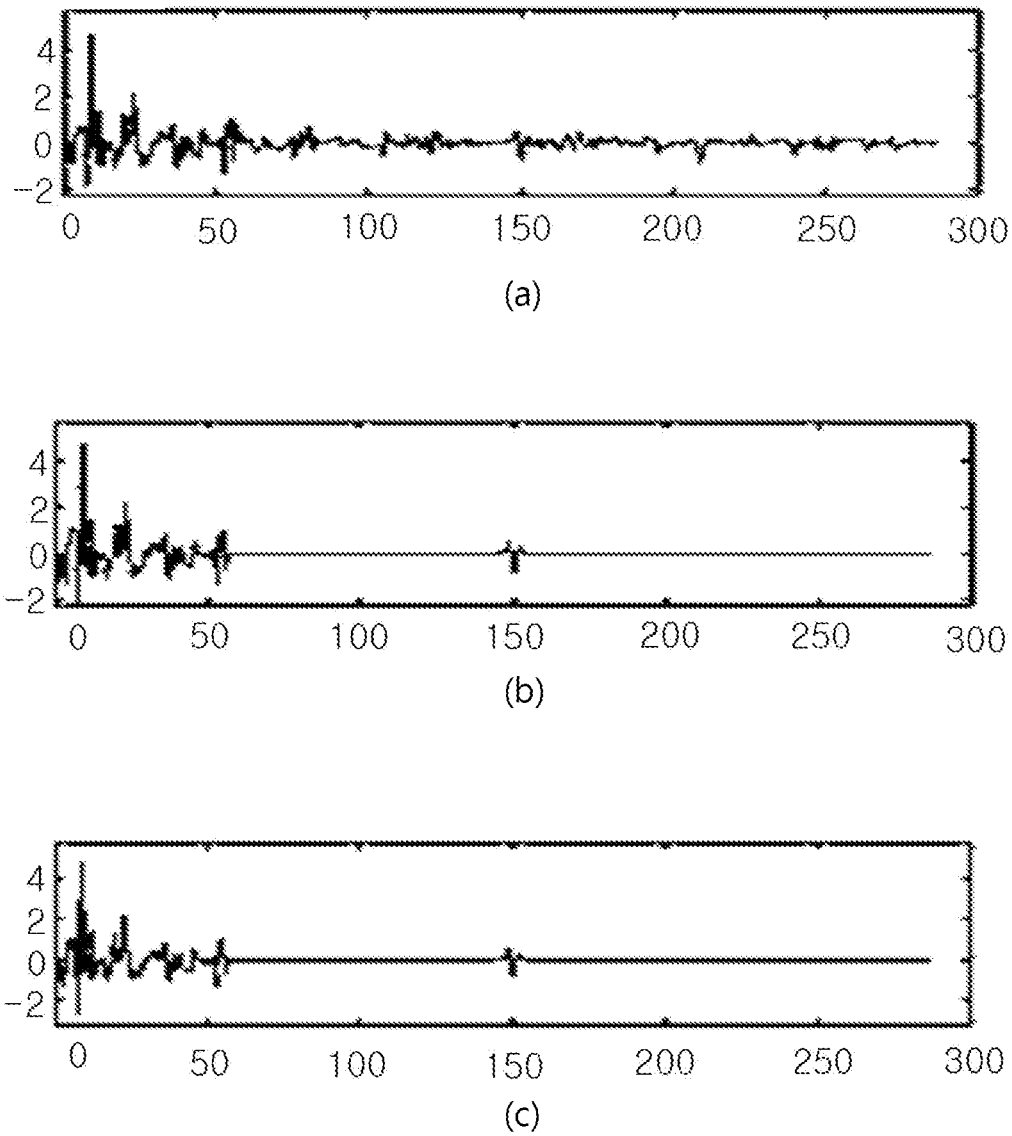
FIG. 9 is a diagram illustrating an example of a process of normalizing a linear prediction residual signal of a quantization-selected band according to an embodiment of the present invention.

FIG. 9 is a diagram illustrating an example of a process of normalizing the linear prediction residual signal of the quantization-selected bands according to an embodiment of the present invention.

Referring to FIG. 9, the upper part of FIG. 9 illustrates frequency transform coefficients of an original linear prediction residual signal and the middle part of FIG. 9 illustrates the frequency bands selected from the original frequency transform coefficients. The lower part of FIG. 9 illustrates the frequency transform coefficients of the linear prediction residual signal in which the selected bands are normalized.

Referring to FIG. 6 again, the normalized frequency transform coefficients of the linear prediction residual signal are quantized based on a selected codebook by comparing the band energy values with the average energy value (step S620).

Codewords of a codebook and the minimum mean square error (MMSE) of the normalized signal to be quantized may be acquired to select indices of the codebook.

In an embodiment of the present invention, different codebooks may be selected using a predetermined expression. The energy of a band to be quantized may be compared with the average energy. A first codebook learned using the bands having high energy is selected when the energy of a frequency band to be quantized is higher than the average energy, and a second codebook learned using the bands having a low energy ratio is selected when the energy of a frequency band to be quantized is lower than the average energy. Shape vector quantization may be performed on the basis of a codebook selected through comparison of the average energy with the energy of the band to be quantized. Expression 4 represents the band energy and the average value thereof.

$$E'(n)=\sum_{k=0}^{7}\{M(n\times 8+k)\}^2 \qquad \text{⟨Expression 4⟩}$$

$$n=0,\ldots,7$$

$$E'_{ave}=\frac{1}{8}\sum_{k=0}^{7}\{E'(n)\}$$

The spectrum is subjected to deshaping and the quantized transform coefficients are inversely transformed to reconstruct the linear prediction residual signal of the time axis 9 step S630).

The spectrum deshaping may be performed as the inverse process of the above-mentioned spectrum pre-shaping, and the inverse transform may be performed after the spectrum deshaping.

The total gain in the time domain is calculated which is acquired through the inverse transform of the quantized linear prediction residual signal (step S640).

The total gain may be calculated on the basis of the linear prediction residual signal subjected to the adaptive windowing of step S520 and the time-axis prediction residual signal inversely transformed to the quantized coefficients calculated in step S630.

Referring to FIG. 7, the linear prediction residual signal quantized in step S640 is subjected to the adaptive windowing again (step S700).

The reconstructed linear prediction residual signal may be adaptively windowed.

The windowed overlap signal is stored to remove the windowed overlap signal from a signal to be transmitted later (step S710). The overlap signal is the same as a section overlapping with a next frame in step S520 and the stored signal is used in the overlap/add process (S720) of the next frame.

The reconstructed prediction residual signal windowed in step S700 is overlapped/added with/to the windowed overlap signal stored in the previous frame to remove discontinuity between frames (step S720).

The comfort noise level is calculated (step S730).

The comfort noise may be used to provide acoustically-improved sound quality.

Figure 10:
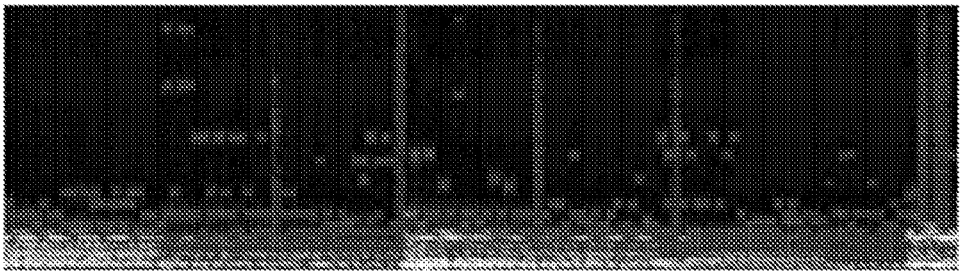
FIG. 10 is a diagram illustrating a signal before and after insertion of comfort noise to show an effect of insertion of a comfort noise level (CN level) according to an embodiment of the present invention.
Figure 10:
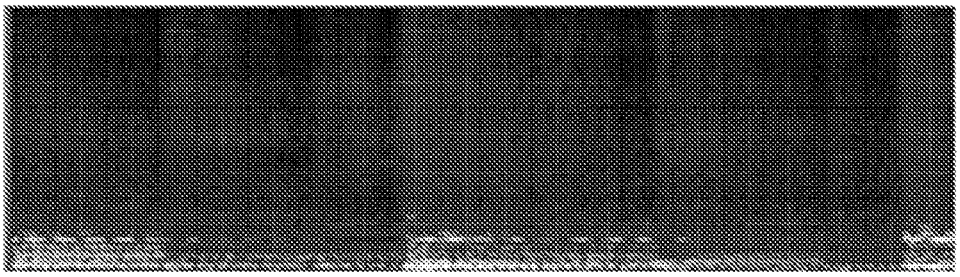

FIG. 10 is a conceptual diagram illustrating a method of inserting a comfort noise level according to an embodiment of the present invention.

The upper part of FIG. 10 shows a case where the comfort noise is not inserted and the lower part of FIG. 10 shows a case where the comfort noise is inserted. The comfort noise may be inserted into a non-quantized band and the comfort noise information may be transmitted to the voice decoder. At the time of listening to a voice signal, noise based on the quantization error and band discontinuity can be recognized from a signal into which the comfort noise is not inserted, but a more stable sound can be recognized from a signal into which the comfort noise is inserted.

Therefore, the noise level of each frame may be calculated through the following process. 18 upper bands of an original signal X(k) are normalized using the calculated gain G. The band energy of each normalized signal $\hat{X}(k)$ is calculated and the total energy $\hat{E}_{total}$ and the average energy $\hat{E}_{avg}$ of the calculated band energy are calculated. Expression 5 represents a process of calculating the total energy and the average energy of bands.

<Expression 5>

$$\hat{E}(n-18) = \sum_{k=0}^{7} \{X(N \times 8 + k)\}^2 \quad n = 18, , \ldots , 35$$

$$\hat{E}_{total} = \sum_{n=0}^{17} \{\hat{E}(n)\}$$

$$\hat{E}_{avg} = 0.8 * \hat{E}_{total} / 18$$

The band energy which is higher than a threshold value of $0.8*\hat{E}_{total}$ in the 18 upper bands may be excluded from the total energy $\hat{E}_{total}$. Here, constant 0.8 is a weighting value calculated by experiments and another value may be used. When the comfort energy level is excessively high, the influence of the band having noise inserted thereto may be larger than that of the quantized band and thus may adversely affect the sound quality. Accordingly, the comfort noise level is determined using only the energy equal to or less than the predetermined threshold value.

Figure 11:
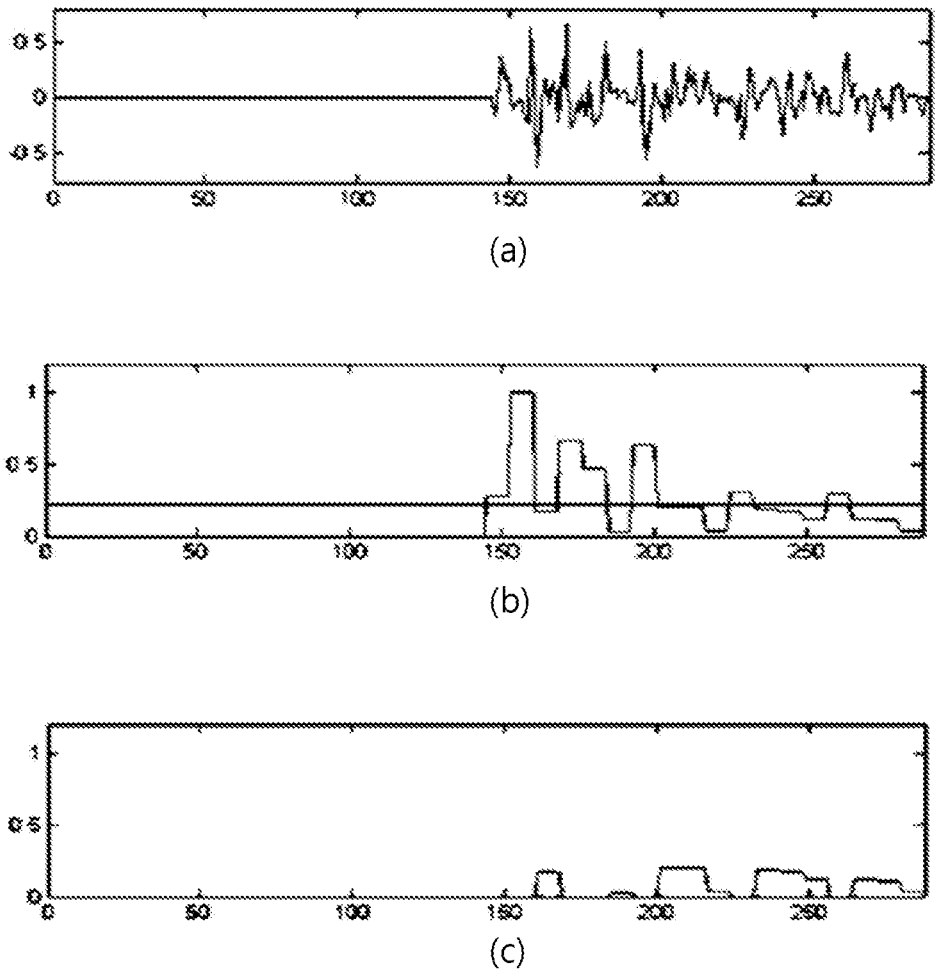
FIG. 11 is a conceptual diagram illustrating a comfort noise calculating method according to an embodiment of the present invention.

FIG. 11 is a conceptual diagram illustrating a method of calculating a comfort noise level according to an embodiment of the present invention.

The upper part of FIG. 11 represents signals of 18 upper frequency bands. The middle part of FIG. 11 represents the threshold value and the energy values of the 18 upper frequency bands. The threshold value may be calculated by multiplying the average energy value by an arbitrary value as described above, and the energy level may be determined using only the energy of the frequency bands higher than the threshold value.

A filter 1/Aw(z) is applied to the calculated voice signal (quantized linear prediction residual signal) to reconstruct a voice signal (step S740).

The LPC filter 1/Aw(z) which is the reciprocal of the filter Aw(z) used in step S500 may be used to generate the reconstructed voice signal. The order of steps S730 and S740 may be exchanged, which also belongs to the scope of the present invention.

Figure 12:
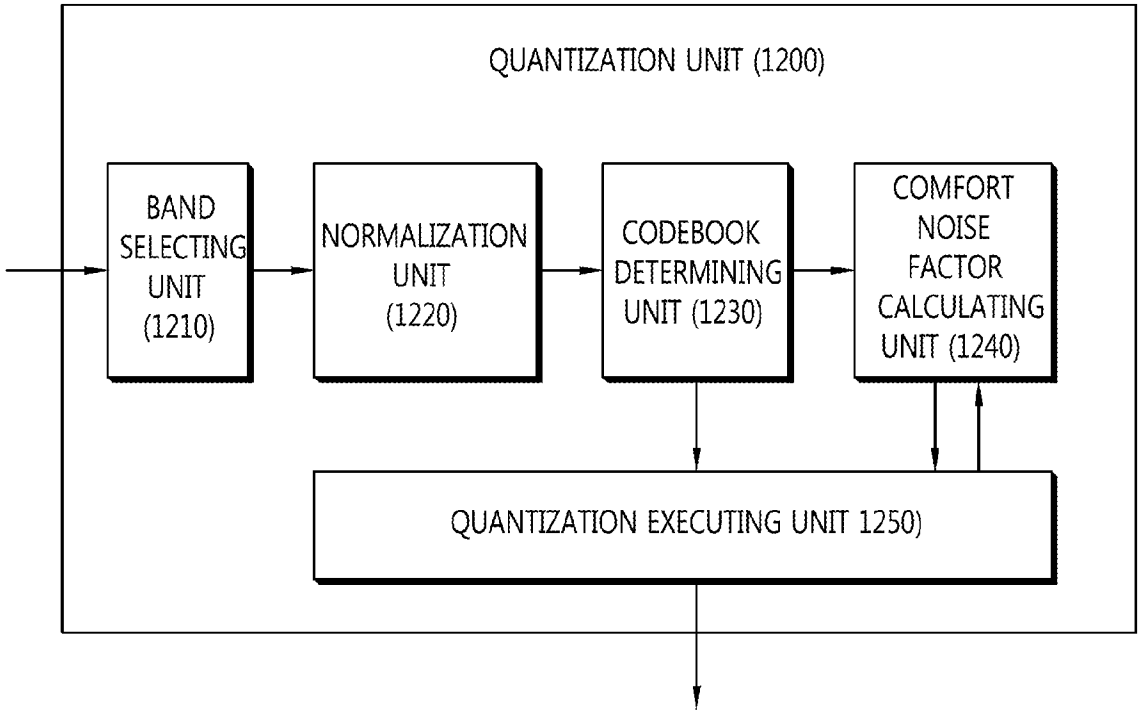
FIG. 12 is a conceptual diagram illustrating a part (a quantization unit of a TCX mode block) of a voice encoder according to an embodiment of the present invention.

FIG. 12 is a conceptual diagram illustrating a part (a quantization unit of a TCX mode block) of a voice encoder according to an embodiment of the present invention.

In FIG. 12, it is assumed that the operations to be described below are all performed in the quantization unit of the voice encoder for the purpose of convenience of explanation. The operations to be described below may be performed by other constituent units of the voice encoder, which also belongs to the scope of the present invention.

Referring to FIG. 12, a quantization unit 1200 of the voice encoder may include a band selecting unit 1210, a normalization unit 1220, a codebook determining unit 1230, a comfort noise factor calculating unit 1240, and an quantization executing unit 1250.

The band selecting unit 1210 may determine a band through pre-shaping and may determine bands to be selected as a fixed low-frequency band and a selected high-frequency band.

The normalization unit 1220 may normalize the selected bands. As described above, the gain value to be normalized is calculated on the basis of the energy of the selected bands and the number of selected samples and a normalized signal is finally obtained.

The codebook determining unit 1230 may determine what codebook to apply to a band on the basis of a predetermined determination expression and may calculate codebook index information.

The comfort noise factor calculating unit 1240 may calculate the noise level to be inserted into a non-selected band on the basis of a predetermined frequency band and may calculate a noise factor for a band not to be quantized on the basis of the calculated noise level value. The voice decoder may generate a reconstructed linear prediction residual signal and a synthesized voice signal on the basis of the noise factor quantized by the voice encoder. The reconstructed linear prediction residual signal may be used as an input of the band predicting unit (which is referenced by reference numeral 154 in FIG. 1). The synthesized voice signal generated by causing the reconstructed linear prediction residual signal to pass through the filter 1/Aw(z) may be input to the mode selecting unit 151 and may be used to select a mode. The quantized noise factor may be quantized and transmitted for generation of the same information in the voice decoder.

The quantization executing unit 1250 may quantize the codebook index information.

Figure 13:
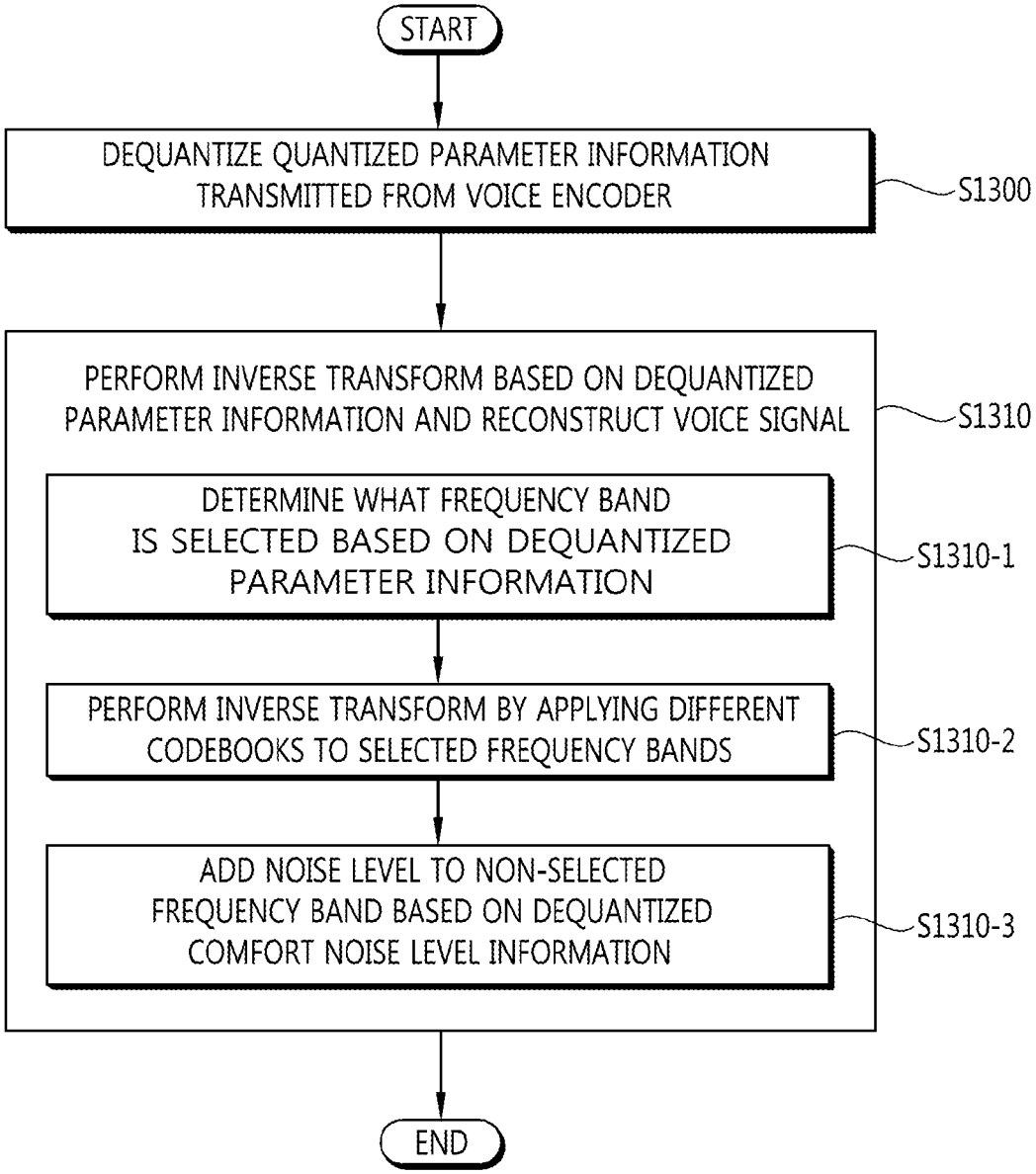
FIG. 13 is a flowchart illustrating a process of dequantizing a TCX mode block according to an embodiment of the present invention.

FIG. 13 is a flowchart illustrating a dequantization process of a TCX mode block according to an embodiment of the present invention.

Referring to FIG. 13, the quantized parameter information transmitted from the voice encoder is dequantized (step S1300).

The quantized parameter information transmitted from the voice encoder may include gain information, shape information, noise factor information, and selected quantization band information. The quantized parameter information is dequantized.

The inverse transform is performed on the basis of the dequantized parameter information to reconstruct a voice signal (step S1310).

It may be determined what frequency bands are selected on the basis of the dequantized parameter information (step S1310-1) and the frequency bands selected as the determination result may be subjected to the inverse transform by applying different codebooks thereto (step S1310-2). A noise level may be added to a non-selected frequency band on the basis of the dequantized comfort noise level information (step S1310-3).

Figure 14:
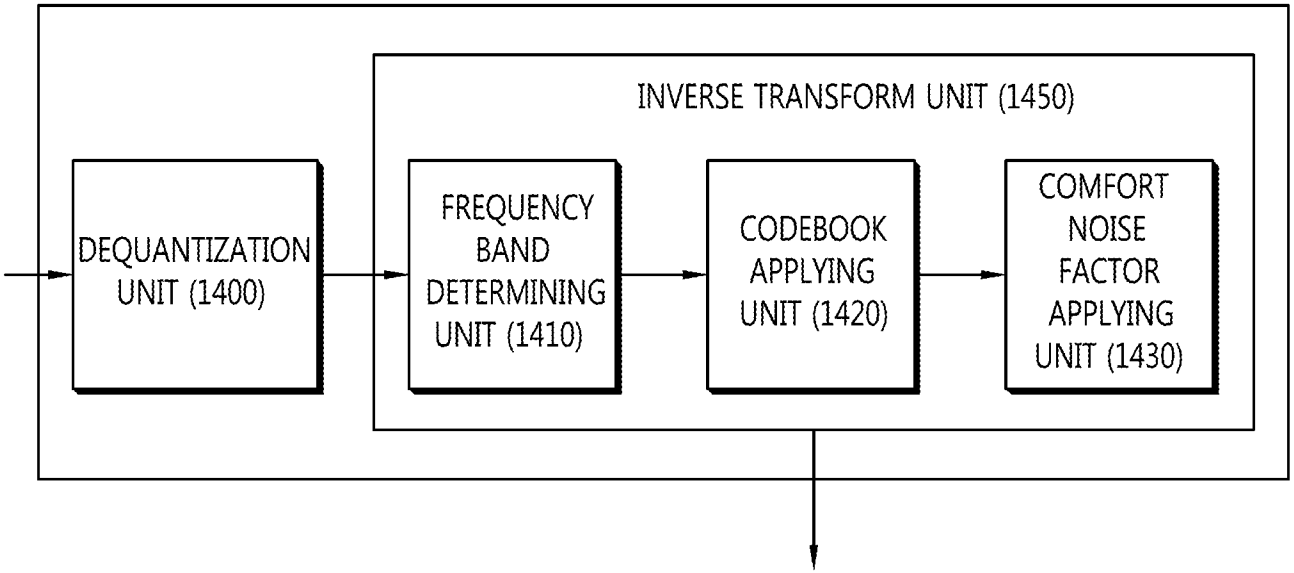
FIG. 14 is a conceptual diagram illustrating a part (a dequantization unit of the TCX mode block) of a voice encoder according to an embodiment of the present invention.

FIG. 14 is a conceptual diagram illustrating a part (a dequantization unit of a TCX mode block) of a voice decoder according to an embodiment of the present invention.

In FIG. 14, similarly to FIG. 12, it is assumed that the operations to be described below are all performed in the quantization unit of the voice encoder for the purpose of convenience of explanation. The operations to be described below may be performed by other constituent units of the voice encoder, which also belongs to the scope of the present invention.

The voice decoder may include a dequantization unit 1400 and an inverse transform unit 1450.

The dequantization unit 1400 may perform dequantization on the basis of the quantized parameter information transmitted from the voice encoder and may extract the gain information, the shape information, the noise factor information, and the selected quantization band information.

The inverse transform unit 1450 may includes a frequency band determining unit 1410, a codebook applying unit 1420, and a comfort noise factor applying unit 1430, and may reconstruct a voice signal on the basis of the dequantized voice parameter information.

The frequency band determining unit 1410 may determine whether a current frequency band is a fixed low-frequency band, a selected high-frequency band, or a frequency band to which the comfort noise factor is applied.

The codebook applying unit 1420 may apply different codebooks to the fixed low-frequency bands or the selected high-frequency bands on the basis of the frequency bands to be quantized which are determined by the frequency band determining unit and the codebook index information transmitted from the dequantization unit 1400.

The comfort noise factor applying unit 1430 may apply the dequantized comfort noise factor to the frequency band to which the comfort noise is added.

FIGS. 15 to 20 are diagrams illustrating an encoding method in a TCX mode using an analysis-by-synthesis (AbS) method according to an embodiment of the present invention.

Figure 15:
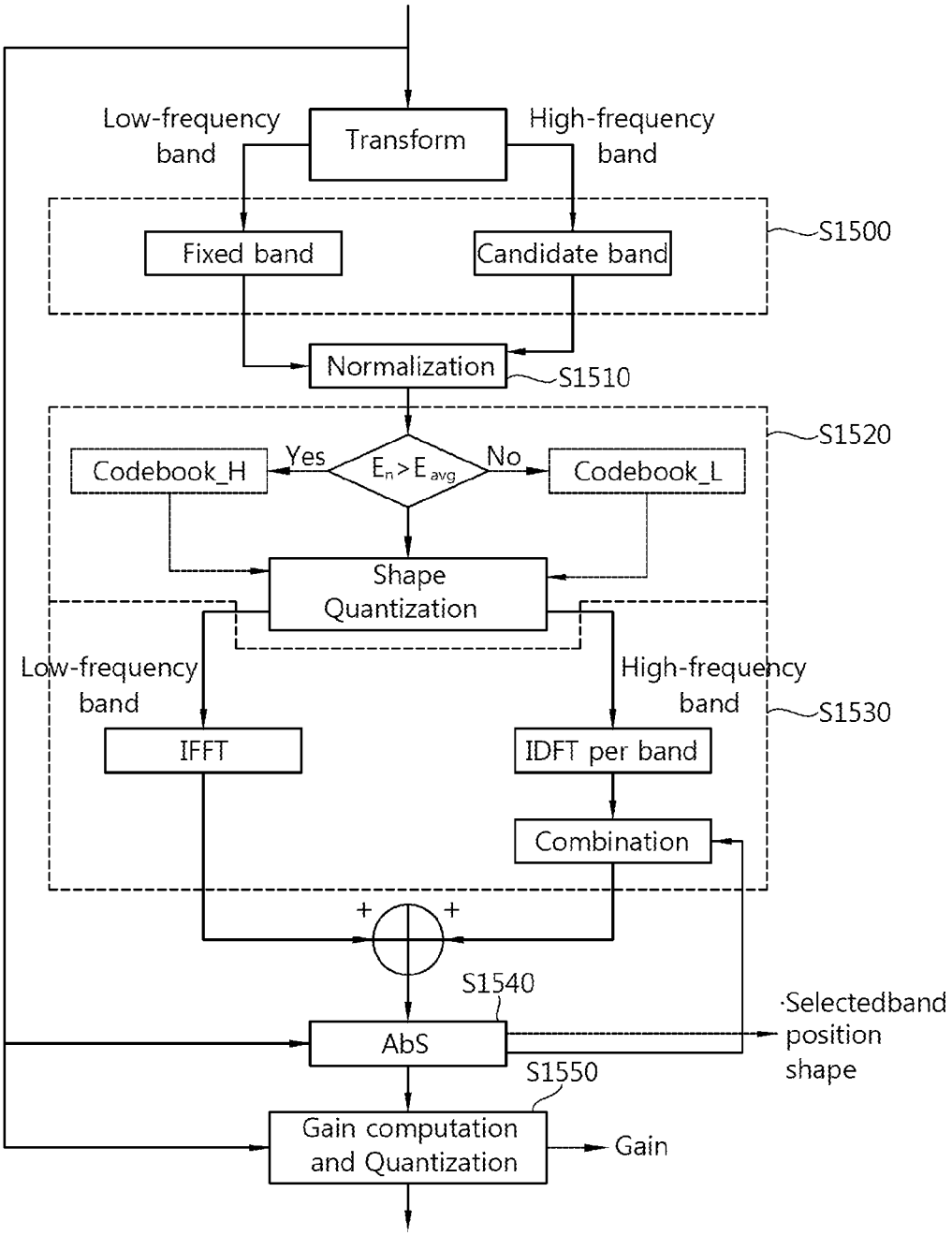
FIGS. 15 to 20 are diagrams illustrating an encoding method in a TCX mode using an analysis-by-synthesis (AbS) method according to an embodiment of the present invention.

FIG. 15 is a diagram illustrating the encoding method in a TCX mode using the analysis-by-synthesis (AbS) method according to an embodiment of the present invention.

The above-mentioned voice encoder uses the method of fixing and quantizing the low-frequency bands, selecting some of the high-frequency bands depending on the band energy, and quantizing the selected high-frequency bands. However, it may be more important to select a band affecting actual sound quality out of frequency bands having an energy distribution of a target signal, that is, a voice signal.

The actual signal to be quantized in the TCX mode is not the original signal which is acoustically listened but a residual signal passing through the filter Aw(z). Accordingly, when the energy is similar, the bands actually affecting the sound quality can be effectively selected and thus the coding efficiency can be enhanced, by synthesizing the signal to be quantized into a signal which is actually listened through the LPC synthesis filter 1/Aw(z) and checking the synthesis result. In the following embodiment of the present invention, a method of selecting optimal bands based on a combination of candidate bands and the Abs structure will be described.

The processes previous to step S1500 in FIG. 15 are the same as the processes of steps S500 to S520 in FIG. 5 and the processes subsequent to step S1540 in FIG. 15 are the same as the processes of steps S700 to S740 in FIG. 7.

In the voice encoding method according to an embodiment of the present invention, the quantization may be performed on the low-frequency bands on the basis of the fixed low-frequency bands in the same way as illustrated in FIG. 6, the candidate-selected bands having a large energy portion may be selected and quantized out of the other high-frequency bands. Finally-selected high-frequency bands are selected among the candidate-selected bands. The number of the candidate-selected high-frequency bands may be larger than the number of the finally-selected high-frequency bands (step S1500).

In step S1500, a frequency band to be quantized may be divided into the fixed low-frequency bands to be normalized and the candidate-selected high-frequency bands. The candidate-selected high-frequency bands may be selected more than the finally-selected high-frequency bands. The optimal combination may be found out of the candidate-selected high-frequency bands as the finally-selected high-frequency bands. The finally-selected high-frequency bands may be finally quantized in the subsequent AbS stage.

In the processes of steps S1510 and S1520, similarly to the processes of steps S610 and S620 in FIG. 6, the selected bands to be quantized are normalized (step S1510) and the normalized linear prediction residual signals are quantized by comparing the band energy values with the average energy value and selecting different codebooks (step S1520).

In order to perform the analysis-by-synthesis (AbS) block (step S1540), time-domain signals for the low-frequency bands are acquired through the inverse transform process on four fixed low-frequency bands and time-domain signals for the high-frequency bands are acquired through the band-selection inverse DFT on the candidate-selected high-frequency bands (step S1530).

Since the analysis-by-synthesis (AbS) process (step S1540) is a process of switching and combining the candidate-selected high-frequency bands. The IFFT having a relatively small computational load is applied to the fixed lower-band signals. The band-selection inverse DFT enabling the inverse transform on each band is applied to the candidate-selected high-frequency bands requiring the time-domain signal for each band. The process of step S1530 will be described below in detail.

The time-domain signals for the quantized linear prediction residual signals are acquired by combination of the signals of the low-frequency bands and the signals of the candidate-selected high-frequency bands passing through the IFFT and the band-selection inverse DFT and the optimal combination is calculated using the AbS (step S1540).

The reconstructed candidate linear prediction residual signals generated by combination of the signals of the low-frequency bands and the signals of the candidate-selected high-frequency bands passing through the IFFT and the band-selection inverse DFT may pass through the filter 1/Aw(z) which is a synthesis filter present in the AbS block to generate audible signals. These signals pass through an auditory weighting filter to generate reconstructed voice signals. The signal-to-noise ratio of these signals pass through an auditory weighting filter can be calculated based on the voice signals acquired by causing the linear prediction residual signals not subjected to the quantization which are target signals of the TCX mode. This process may be repeatedly performed by the number of candidate combinations to finally determine the combination of candidate bands having the highest signal-to-noise ratio as the selected bands. The quantized transform coefficient values of the finally-selected high-frequency bands are selected from the quantized transform coefficient values of the candidate-selected high-frequency bands quantized in step S1520.

The gain is calculated and quantized (step S1550).

In step S1550, the gain value may be calculated and quantized on the basis of the time-axis linear prediction residual signals and the linear prediction residual signals synthesized in step S1540.

The band-selection inverse transform (BS-IDFT) proposed in the AbS structure according to the embodiment of the present invention may minimize the computational load through the inverse transform of the bands of the combination. That is, the computational load in application of the AbS structure may be reduced by applying the IFFT having a relatively small computational load to the fixed low-frequency bands and applying the BS-IDFT to the candidate-selected high-frequency bands so as to acquire the time-domain signal for each band. Expression 6 represents the inverse discrete Fourier transform (IDFT) according to the embodiment of the present invention.

<Expression 6>

$$x[n] = \sum_{k=0}^{N-1} X[k]e^{j2\pi nk/N} = \sum_{k=0}^{N-1} \mathrm{Re}X[k](\cos(j2\pi nk/N) + j\sin(j2\pi nk/N)) - \mathrm{Im}X[k](\sin(j2\pi nk/N) - j\cos(j2\pi nk/N))$$

Since the BS-IDFT according to the embodiment of the present invention is the inverse transform performed on the frequency components of the selected bands. By using the BS-IDFT, the computational load may be reduced from $k_{DFT}N^2$ to $k_{band}N^2$ by by the number of samples $k_{band}$ of each band. Since the BS-IDFT is performed on only necessary parts in comparison with a case where the IFFT is performed, the computational load may be reduced.

Figure 16:
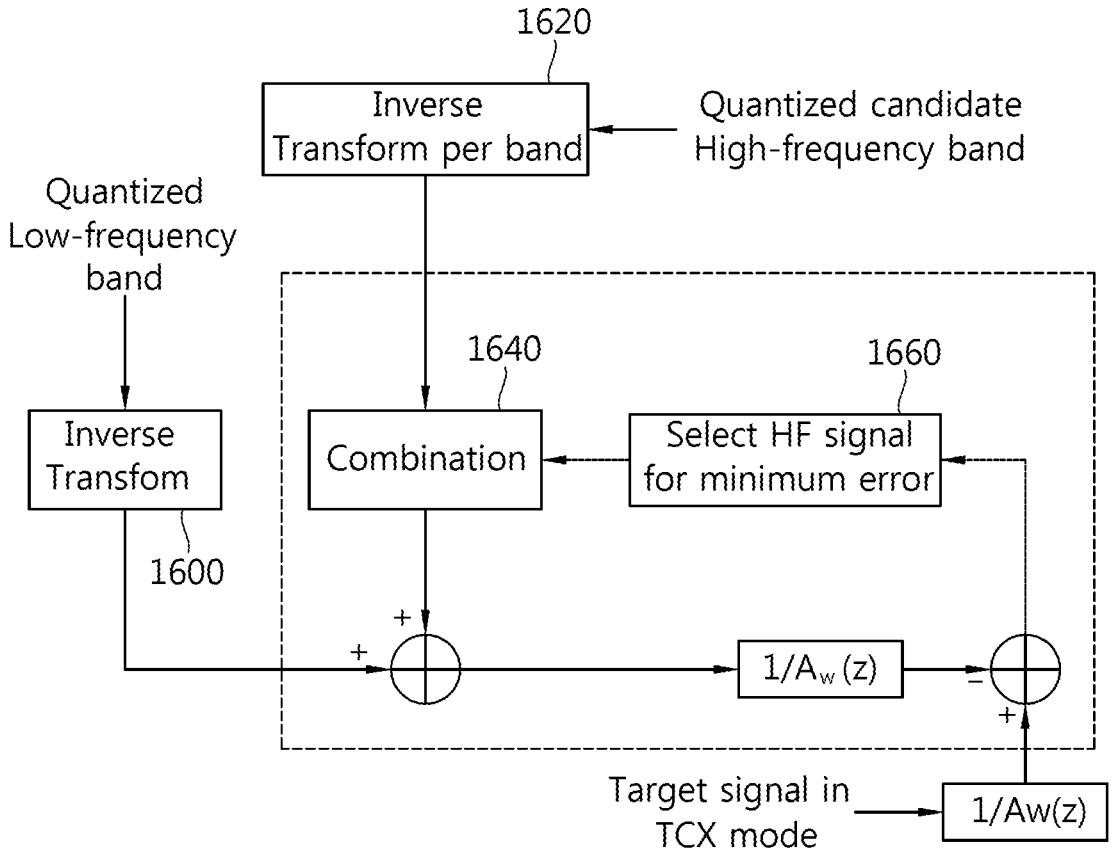

FIG. 16 is a conceptual diagram illustrating a method of applying the BS-IDFT to the AbS structure according to an embodiment of the present invention.

In the AbS method according to the embodiment of the present invention, the time-domain signal for each candidate band may be acquired using a method of performing the BS-IDFT outside the AbS structure so as not to repeatedly perform the inverse transform.

Referring to FIG. 16, the IFFT is performed on four fixed low-frequency bands (1600), the dequantization is performed on the candidate-selected high-frequency bands outside the AbS block (S1540) (1620), and the synthesization is performed by combination of the time-domain signals of the candidate-selected high-frequency bands inside the AbS block (S1540). The reconstructed linear prediction residual signals of the time domain synthesized by combination of the fixed low-frequency bands and the candidate-selected high-frequency bands pass through the filter 1/Aw(z) to generate reconstructed voice signals. The combination of the high-frequency bands having the optimal ratio may be selected based on the signal-to-noise ratio of the reconstructed voice signals and the input signals in the TCX mode, that is, the time-domain linear prediction signals to be quantized.

Figure 17:
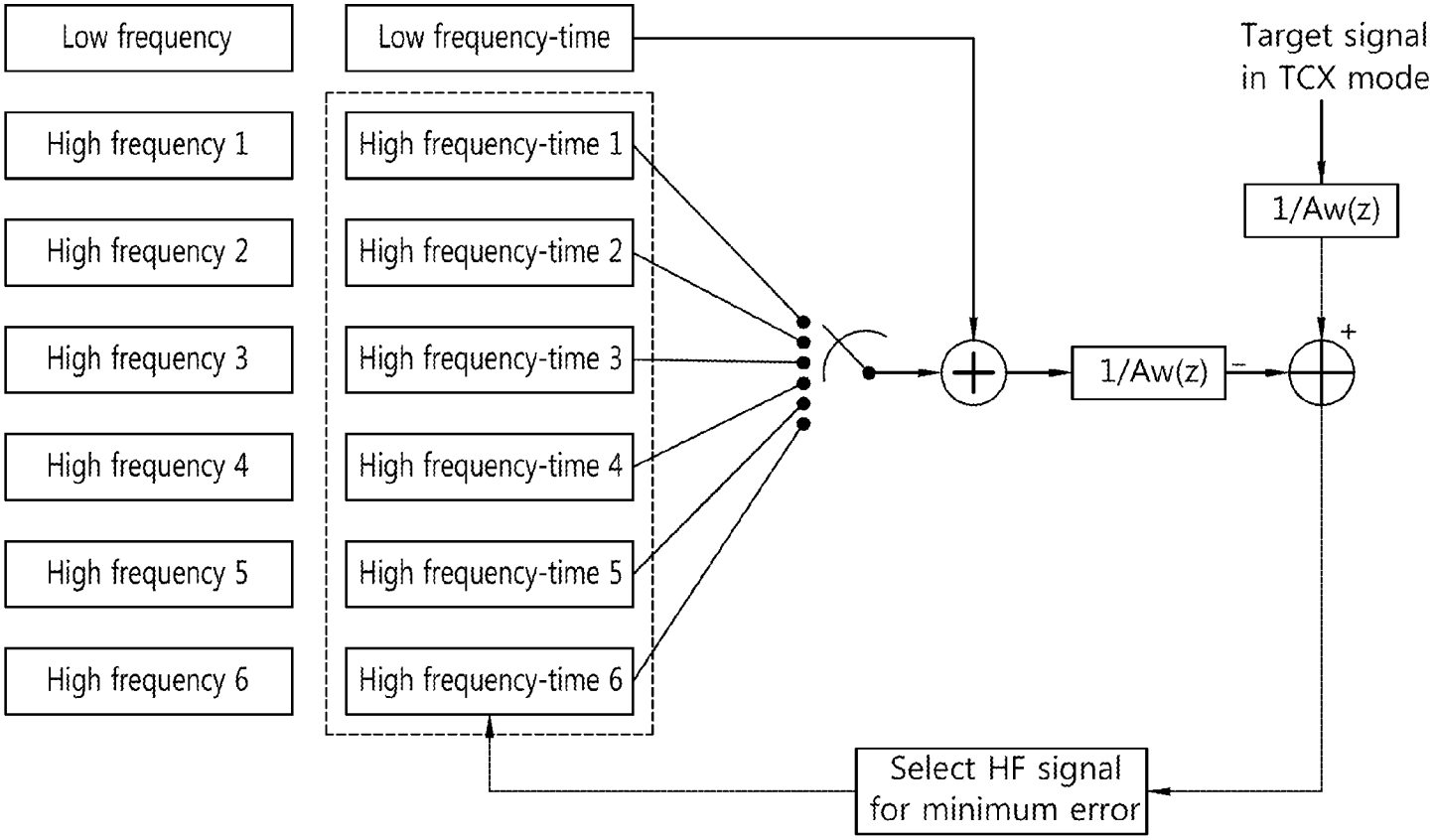
Figure 21:
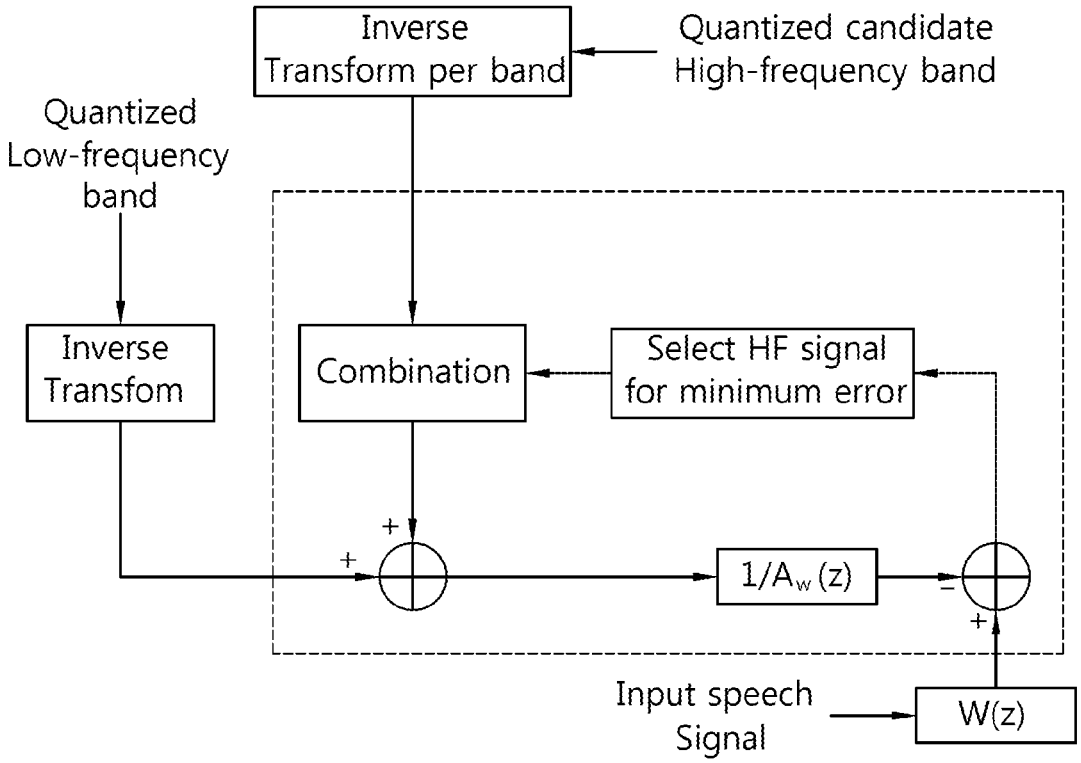
FIGS. 21, 22, and 23 are conceptual diagrams illustrating a case where an input voice signal as a comparison signal for selecting an upper-band signal combination in an AbS passes through an auditory-recognition weighting filter W(z).

Signals obtained by causing the input voice signals to pass through an auditory-recognition weighting filter such as W(z) may be used as the comparison signal for selecting the combination of the optimal high-frequency bands, as illustrated in FIG. 21. FIG. 17 is a conceptual diagram illustrating the BS-IDFT which is performed in a front stage of the AbS structure according to the embodiment of the present invention.

Referring to FIG. 17, the IFFT may be applied to the fixed low-frequency bands and an optimal combination minimizing an error may be generated for the candidate-selected high-frequency bands.

Figure 22:
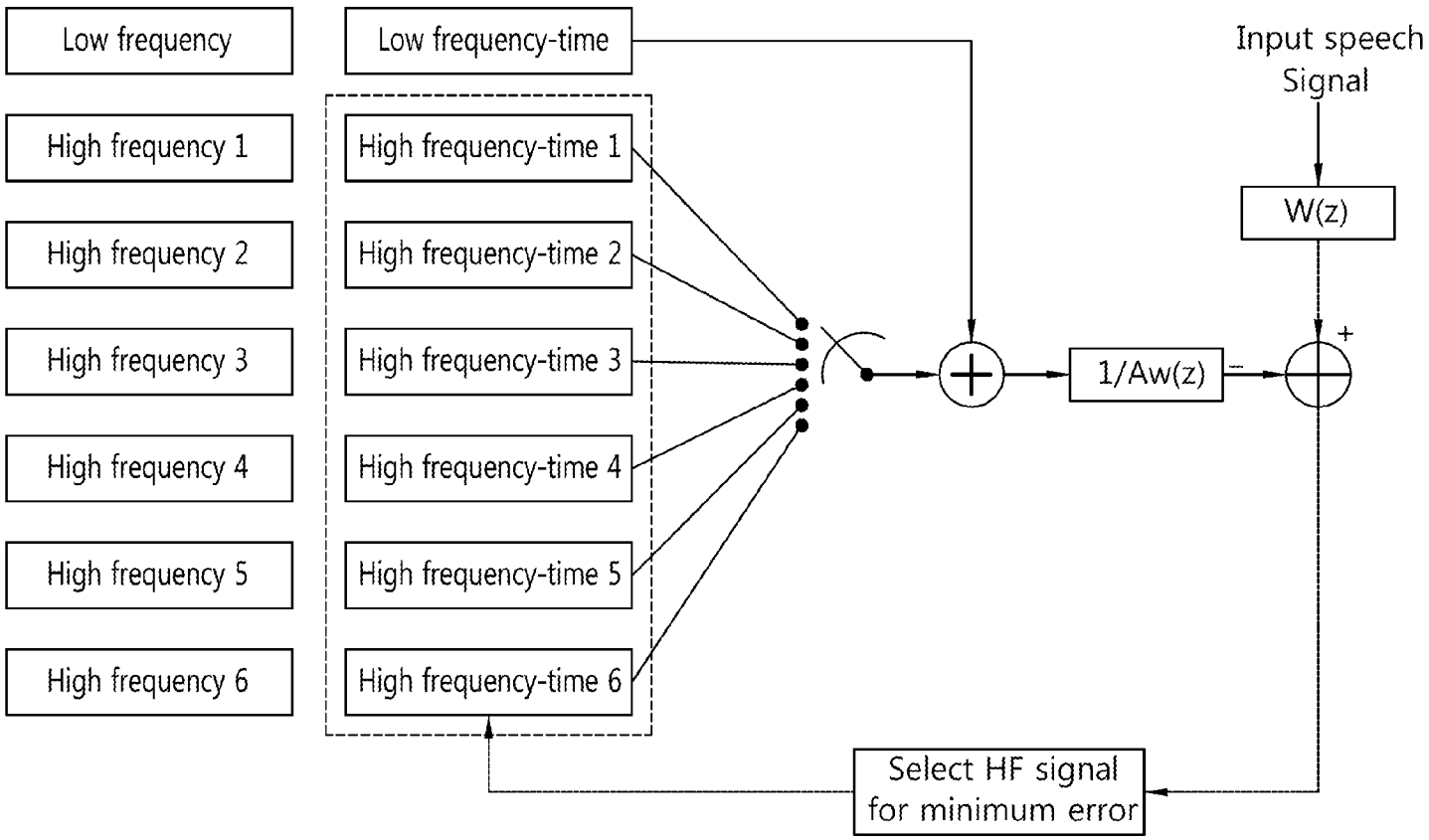
Figure 23:
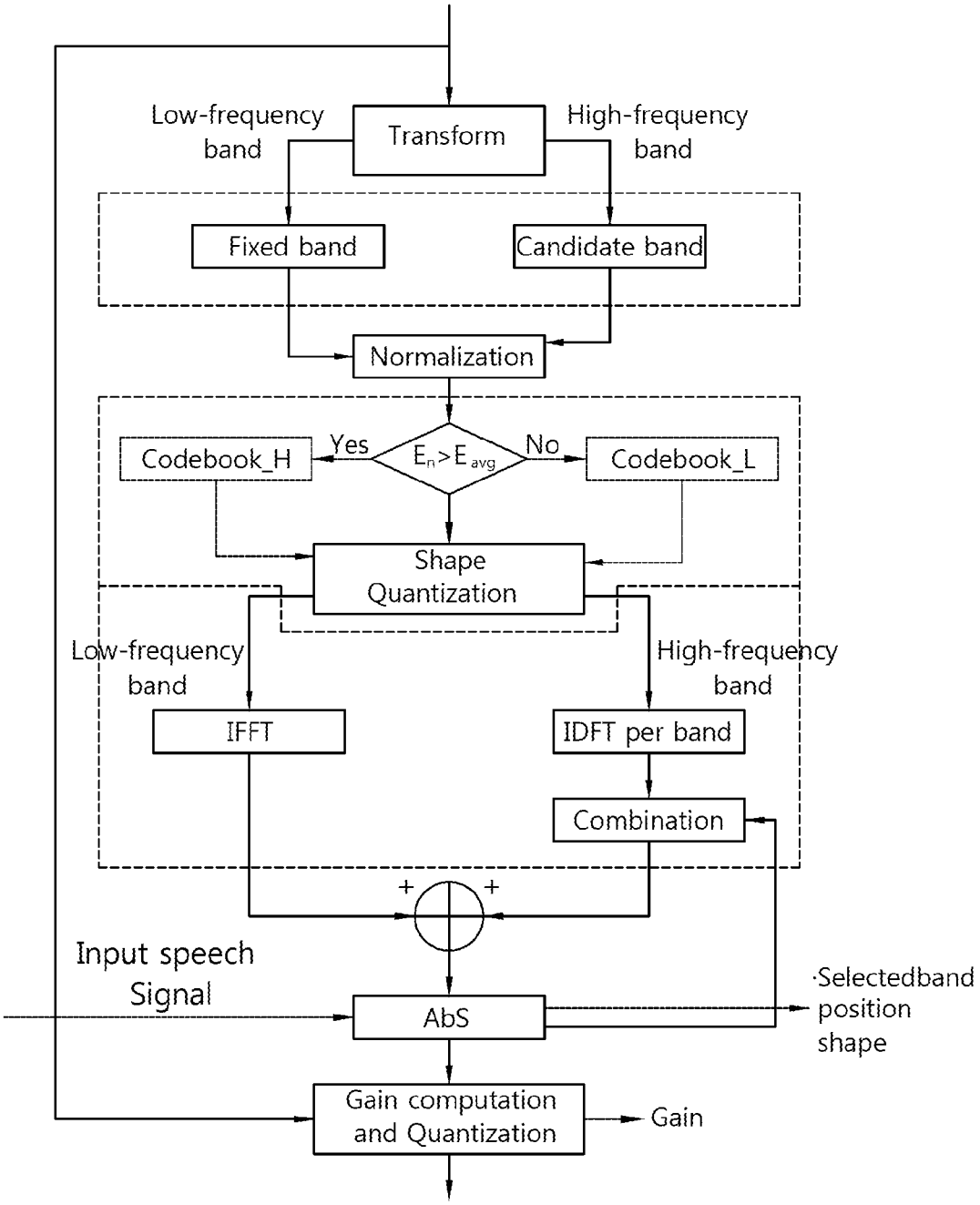

In FIG. 17, similarly, the signals obtained by causing the input voice signals to pass through an auditory-recognition weighting filter such as W(z) may be used as the comparison signal for selecting the combination of the optimal high-frequency bands, as illustrated in FIG. 22. Similarly to FIGS. 22 and 23, the AbS unit illustrated in FIG. 22 may use the input voice signal instead of the linear prediction residual coefficient information to select a high-frequency band combination, as illustrated in FIG. 23.

Figure 18:
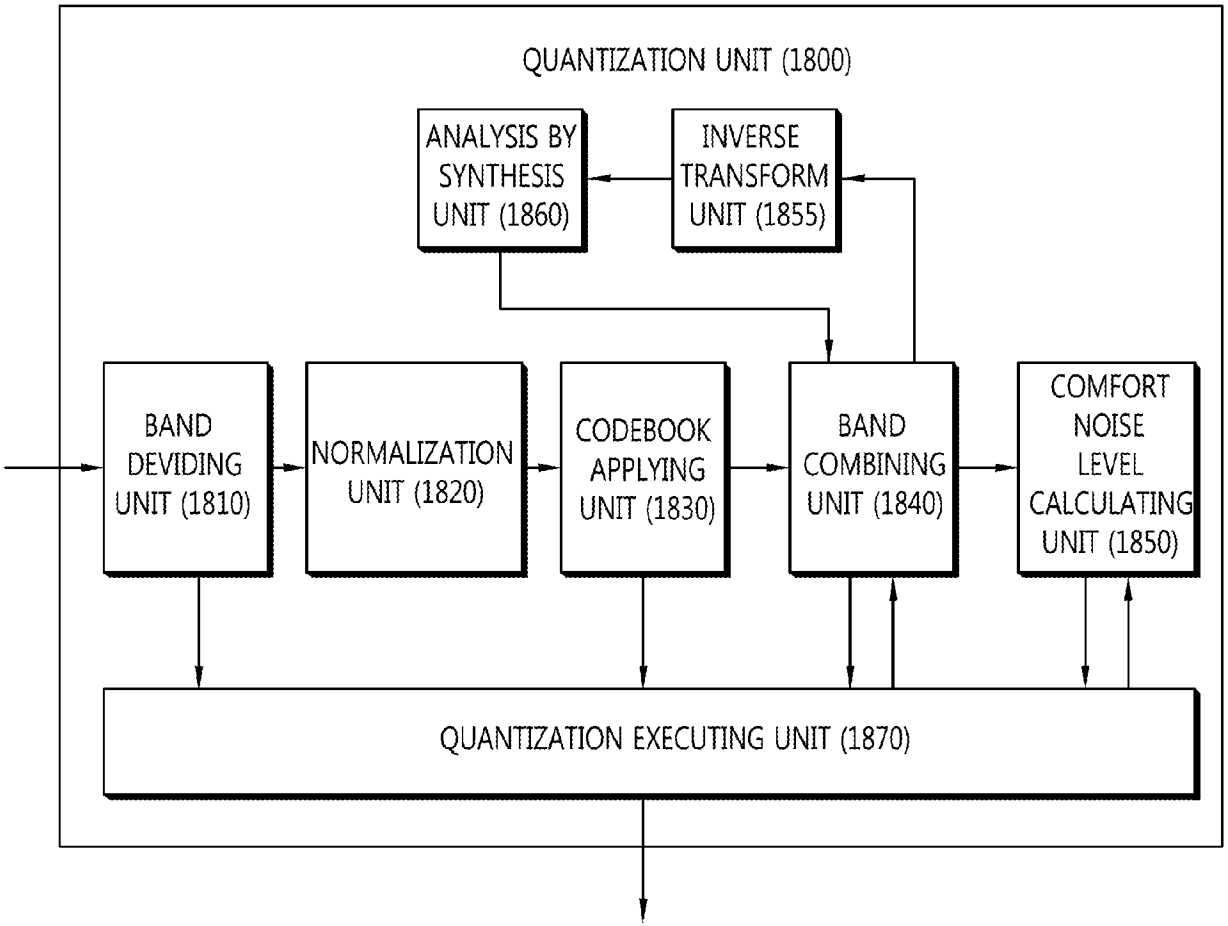

FIG. 18 is a conceptual diagram illustrating a part of the voice encoder according to the embodiment of the present invention.

Referring to FIG. 18, the voice encoder may include a quantization unit 1800 and an inverse transform unit 1855. The quantization unit 1800 may include a band dividing unit 1810, a normalization unit 1820, a codebook applying unit 1830, a band combining unit 1840, a comfort noise level calculating unit 1850, an inverse transform unit 1855, an analysis-by-synthesis unit 1860, and a quantization executing unit 1870.

The band dividing unit 1810 may divide the frequency bands into fixed low-frequency bands and candidate-selected high-frequency bands. That is, the frequency bands may be divided into the fixed low-frequency bands and the candidate-selected high-frequency bands to be normalized. Some candidate-selected high-frequency bands of the all candidate-selected high-frequency bands may be determined to be selected as the finally-selected high-frequency bands by the analysis-by-synthesis (AbS) unit 1860 by combination.

The normalization unit 1820 may normalize the fixed low-frequency bands and candidate-selected high-frequency bands selected by the band dividing unit. As described above, the gain values to be normalized are calculated on the basis of the energy of the selected bands and the number of selected samples, and the normalized signals are finally obtained.

The codebook applying unit 1830 may determine what codebook to apply to each band on the basis of a predetermined determination expression. The codebook index information may be transmitted to the quantization executing unit 1870 and may be quantized thereby.

The high-frequency band combining unit 1840 may determine what combination of the selected high-frequency bands should be selected by the inverse transform unit 1855.

The quantization executing unit 1870 may quantize voice parameter information for reconstructing the linear prediction residual signal, such as information on the selected bands, information on the codebook index applied to each band, and information on the comfort noise factor.

The inverse transform unit 1855 may perform the inverse transform by applying the IFFT to the fixed low-frequency bands and the BS-IDFT to the candidate-selected high-frequency bands.

The analysis-by-synthesis (AbS) unit 1860 may select the optimal selected high-frequency band combination by combining the candidate-selected high-frequency bands subjected to the BS-IDFT and repeatedly comparing the combination with the original signals. The finally-determined selected high-frequency band information may be transmitted to the quantization executing unit 1870.

The comfort noise level calculating unit 1850 may determine the noise level which is into a non-selected band on the basis of a predetermined frequency band. The noise factor values based on the noise levels are quantized and transmitted by the quantization executing unit 1870.

Figure 19:
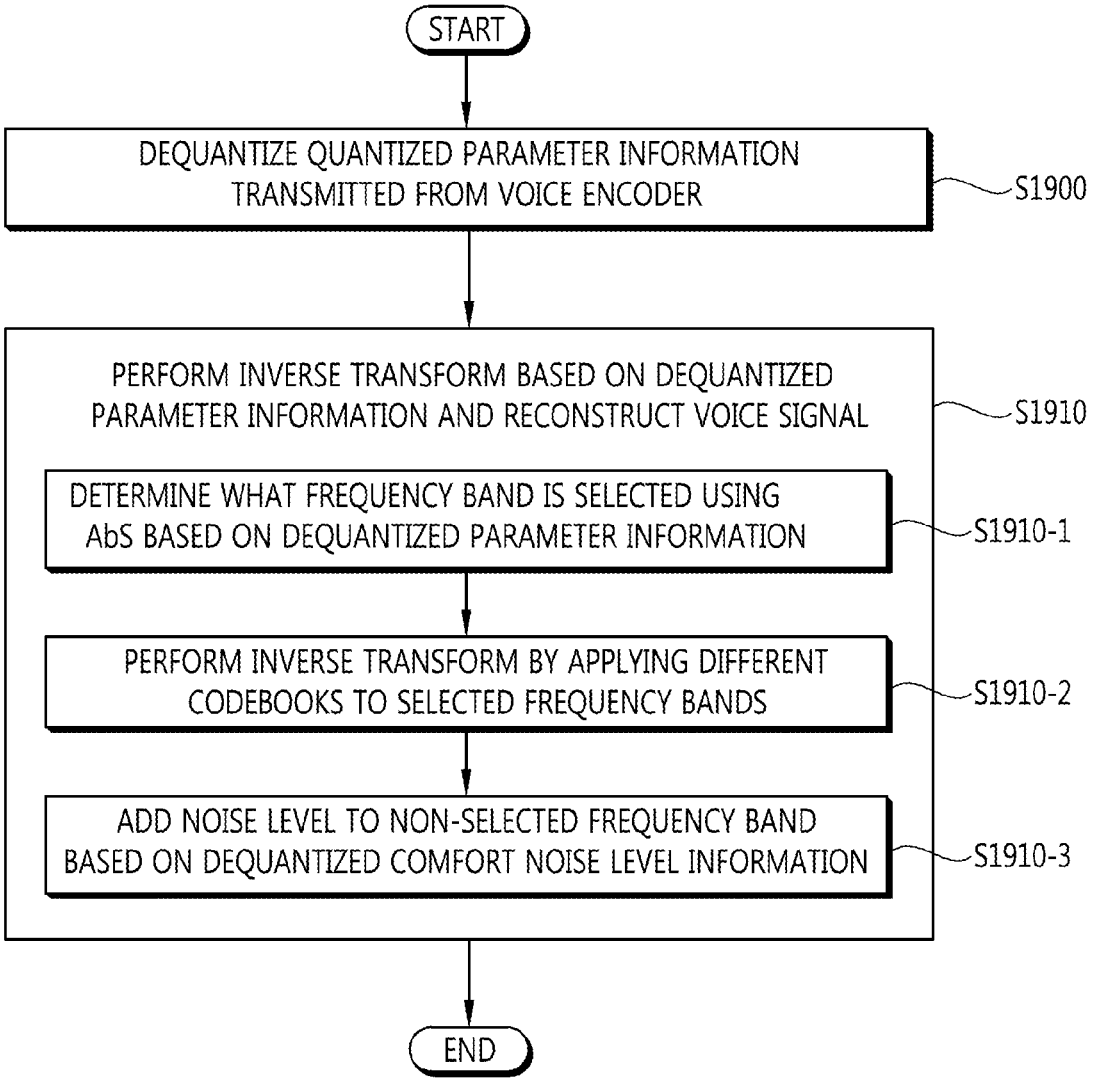

FIG. 19 is a flowchart illustrating a voice decoding method according to an embodiment of the present invention.

Referring to FIG. 19, first, the quantized parameter information transmitted from the voice encoder is dequantized (step S1900).

The quantized parameter information transmitted from the voice encoder may include gain information, shape information, noise factor information, and selected quantization band information selected as a quantization target by the AbS structure of the voice encoder. The quantized parameter information is dequantized.

The inverse transform is performed on the basis of the dequantized parameter information (step S1910).

It may be determined what frequency band is selected on the basis of the selected quantization band information selected as the quantization target by the AbS (step S1910-1), and the inverse transform may be performed by applying different codebooks to the selected frequency bands depending on the determination result (step S1910-2). A noise level may be added to a non-selected frequency band on the basis of the dequantized comfort noise level information (step S1910-3).

Figure 20:
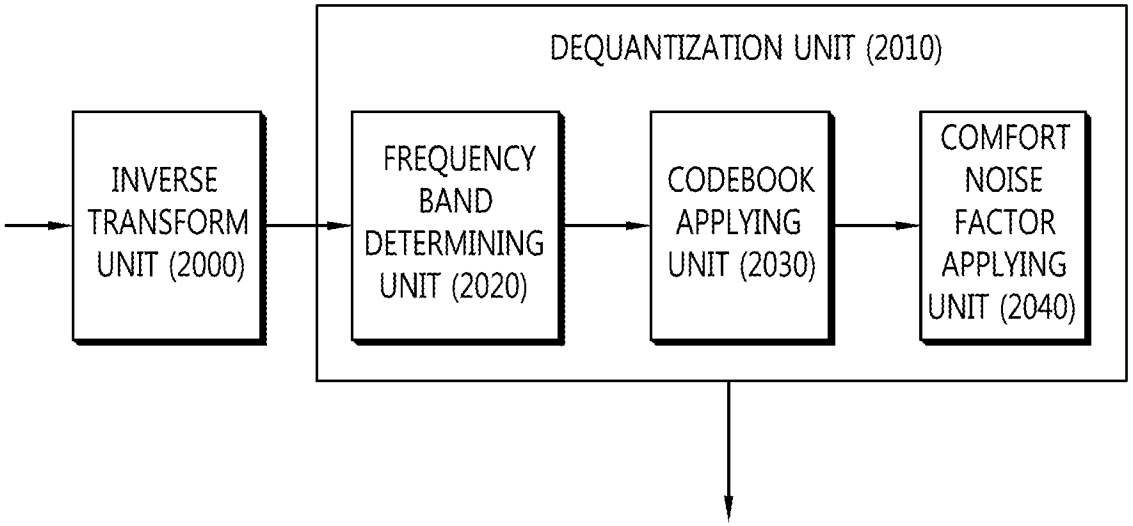

FIG. 20 is a conceptual diagram illustrating a part of a voice decoder according to an embodiment of the present invention.

In FIG. 20, it is assumed that the operations to be described below are all performed in the quantization unit of the voice encoder for the purpose of convenience of explanation. The operations to be described below may be performed by other constituent units of the voice encoder, which also belongs to the scope of the present invention.

The voice decoder may include a dequantization unit 2000 and an inverse transform unit 2010.

The dequantization unit 2000 may perform dequantization on the basis of the quantized parameter information transmitted from the voice encoder and may extract the gain information, the shape information, the noise factor information, and the selected quantization band information selected by the AbS unit of the voice encoder.

The inverse transform unit 2010 may includes a frequency band determining unit 2020, a codebook applying unit 2030, and a comfort noise factor applying unit 2040.

The frequency band determining unit 2020 may determine whether a current frequency band is a fixed low-frequency band, a selected high-frequency band, or a frequency band to which the comfort noise factor is applied.

The codebook applying unit 2030 may apply different codebooks to the fixed low-frequency bands or the selected high-frequency bands on the basis of the frequency bands to be quantized which are determined by the frequency band determining unit and the codebook index information transmitted from the dequantization unit 2000.

The comfort noise factor applying unit 2040 may apply the dequantized comfort noise level to the frequency band to which the comfort noise is added.

FIGS. 21, 22, and 23 illustrate a case where input voice signals pass through the auditory-recognition weighting filter W(z) as comparison signals for selecting the high-frequency band combination as described above. The other elements in FIGS. 21, 22, and 23 are the same as illustrated in FIGS. 16, 17, and 15.

The voice encoding and decoding methods described above may be performed by the constituent units of the voice encoder and the voice decoder described above with reference to FIGS. 1 to 4.

While the present invention has been described above with reference to the embodiments, it will be understood by those skilled in the art that the present invention can be modified and changed in various forms without departing from the spirit and scope of the present invention described in the appended claims.

The invention claimed is:

1. A method of voice decoding by a voice decoder, the method comprising:

receiving, by the voice decoder, encoded voice information from a voice encoder, the encoded voice information including voice parameter information;

dequantizing, by the voice decoder, the voice parameter information extracted from selectively-quantized voice bands; and reconstructing, by the voice decoder, a voice signal by performing an inverse transform based on the dequantized voice parameter information, wherein the selectively-quantized voice bands include at least one predetermined fixed low-frequency voice band to be quantized and at least one selected high-frequency voice band to be quantized, wherein the inverse transform is performed for the at least one predetermined fixed low-frequency voice band to be quantized based on a first codebook, wherein the inverse transform is performed for the at least one selected high-frequency voice band to be quantized based on a second codebook, wherein the at least one selected high-frequency voice band to be quantized is determined based on a signal-to-noise ratio of a reconstructed voice signal being filtered by an auditory-recognition weighting filter and an original signal, wherein the reconstructed voice signal is generated based on linear prediction residual signals being filtered by the auditory-recognition weighting filter, and wherein the linear prediction residual signals are generated based on a combination of the at least one predetermined fixed low-frequency voice band to be quantized and candidate bands for the at least one selected high-frequency voice band to be quantized.

2. The method of claim 1, wherein the at least one selected high-frequency voice band is a high-frequency band having a large energy portion which is selected on the basis of energy distribution information of a voice band.

3. The method of claim 1, wherein the reconstructing comprises:

reconstructing the voice signal based on the first codebook and a first voice parameter information related to the at least one predetermined fixed low-frequency voice band to be quantized; and reconstructing the voice signal based on the second code book and a second voice parameter information related to the at least one selected high-frequency voice band to be quantized, wherein the voice parameter information includes the first voice parameter information and the second voice parameter information.

4. The method of claim 3, wherein the reconstructing further comprises:

reconstructing the voice signal by applying a comfort noise level to a voice band not to be quantized without the selectively-quantized voice band.

5. The method of claim 1, wherein the voice parameter information is generated by applying an inverse direct Fourier transform (IDFT)on the at least one high-frequency voice band to be quantized and an inverse fast Fourier transform (IFFI) on the low-frequency voice band to be quantized.

6. A voice decoder comprising:

a receiver configured to receive encoded voice information including voice parameter information from a voice encoder, a dequantization unit configured to dequantize the voice parameter information extracted from a selectively-quantized voice bands; and a reconstruct unit configured to reconstruct a voice signal by performing an inverse transform based on the dequantized voice parameter information, wherein the selectively-quantized voice bands include at least one predetermined fixed low-frequency voice band to be quantized and at least one selected high-frequency voice band to be quantized, wherein the inverse transform is performed for the at least one predetermined fixed low-frequency voice band to be quantized based on a first codebook, wherein the inverse transform is performed for the at least one selected high-frequency voice band to be quantized based on a second codebook, wherein the at least one selected high-frequency voice band to be quantized is determined based on a signal-to-noise ratio of a reconstructed voice signal being filtered by an auditory -recognition weighting filter and an original signal, wherein the reconstructed voice signal is generated based on linear prediction residual signals being filtered by the auditory-recognition weighting filter, and wherein the linear prediction residual signals are generated based on a combination of the at least one predetermined fixed low-frequency voice band to be quantized and candidate bands for the at least one selected high-frequency voice band to be quantized.

7. The voice decoder of claim 6, wherein reconstruct unit is configured to:

reconstruct the voice signal based on the first codebook and a first voice parameter information related to the at least one predetermined fixed low-frequency voice band to be quantized, and reconstruct the voice signal based on the second code book and a second voice parameter information related to the at least one selected high-frequency voice band to be quantized, wherein the voice parameter information includes the first voice parameter information and the second voice parameter information.

8. The voice decoder of claim 6, wherein the voice parameter information is generated by applying an inverse direct Fourier transform (IDFT) on the at least one high frequency voice band to be quantized and an inverse fast Fourier transform (IFFT) on the at least one low-frequency voice band to be quantized.

9. The voice decoder of claim 7, wherein reconstruct unit is further configured to reconstruct the voice signal by applying a comfort noise level to a voice band not to be quantized without the selectively-quantized voice band.

* * * * *